US007628462B2

(12) United States Patent
Iwao et al.

(10) Patent No.: US 7,628,462 B2
(45) Date of Patent: Dec. 8, 2009

(54) DROPLET DISCHARGE DEVICE AND METHOD OF DRIVING THE SAME

(75) Inventors: Naoto Iwao, Nagoya (JP); Ayumu Matsumoto, Kokubu (JP)

(73) Assignees: Brother Kogyo Kabushiki Kaisha, Nagoya-shi, Aichi-ken (JP); Kyocera Corporation, Kyoto-shi, Kyoto (JP)

( * ) Notice: Subject to any disclaimer, the term of this patent is extended or adjusted under 35 U.S.C. 154(b) by 181 days.

(21) Appl. No.: 11/276,316

(22) Filed: Feb. 23, 2006

(65) Prior Publication Data

US 2006/0187263 A1 Aug. 24, 2006

(30) Foreign Application Priority Data

Feb. 23, 2005 (JP) ..... 2005-046639

(51) Int. Cl.
*B41J 29/38* (2006.01)

(52) U.S. Cl. ..... 347/11; 347/10; 347/9; 347/57

(58) Field of Classification Search ..... 347/9–11, 347/57, 68
See application file for complete search history.

(56) References Cited

U.S. PATENT DOCUMENTS

| | | | |
|---|---|---|---|
| 5,736,994 | A | 4/1998 | Takahashi |
| 6,141,113 | A | 10/2000 | Takahashi |
| 6,254,213 | B1 | 7/2001 | Ishikawa |
| 6,412,925 | B1 | 7/2002 | Takahashi |
| 6,488,349 | B1 | 12/2002 | Matsuo et al. |
| 6,523,923 | B2 | 2/2003 | Sekiguchi |
| 6,575,544 | B2 | 6/2003 | Iriguchi |
| 2003/0146956 | A1 | 8/2003 | Takahashi |
| 2004/0090476 | A1 | 5/2004 | Sekiguchi |
| 2004/0207671 | A1* | 10/2004 | Kusunoki et al. ..... 347/10 |
| 2004/0246315 | A1 | 12/2004 | Takahashi |
| 2005/0259124 | A1 | 11/2005 | Sekiguchi |

FOREIGN PATENT DOCUMENTS

EP 0775579 A 5/1997

(Continued)

OTHER PUBLICATIONS

European Search Report, EP Appl'n No. 06 00 3731 (Counterpart to U.S. Appl. No. 11/276,316) dated May 2, 2006.

*Primary Examiner*—Matthew Luu
*Assistant Examiner*—Henok Legesse
(74) *Attorney, Agent, or Firm*—Baker Botts, LLP

(57) ABSTRACT

In order to preserve good droplet discharge efficiency in a droplet discharge device, a plurality of timings are set within a period in which a plurality of droplets are to be discharged to a target position. Consecutive timings are divided by a cycle time of pressure wave that is generated inside a pressure chamber by transmitting a signal to an actuator. When a plurality of signals are applied to the actuator at consecutive timings, the peak of the pressure wave and the application of the signals are synchronous, and the droplet discharge efficiency will be improved. However, the consecutive number of timings at which the consecutive signals are transmitted is limited to a predetermined number. In this way, the pressure inside the pressure chamber can be prevented from becoming too high.

13 Claims, 18 Drawing Sheets

FOREIGN PATENT DOCUMENTS

| | | | |
|---|---|---|---|
| JP | 7178894 | A | 7/1995 |
| JP | 2002137390 | A | 5/2002 |
| JP | 2003080707 | A | 3/2003 |
| JP | 2003136690 | A | 5/2003 |
| WO | 2005000589 | | 1/2005 |
| WO | 2005000589 | A1 | 1/2005 |

* cited by examiner ( a )

( b )

DROPLET DISCHARGE DEVICE AND METHOD OF DRIVING THE SAME

CROSS-REFERENCE TO RELATED APPLICATION

This application claims priority to Japanese Patent Application No. 2005-046639 filed on Feb. 23, 2005, the contents of which are hereby incorporated by reference into the present application.

BACKGROUND OF THE INVENTION

1. Field of the Invention

The present invention relates toga droplet discharge device, a drive device for the same, and a method of driving the same.

2. Description of the Related Art

A droplet discharge device such as an ink jet printer is widely known. Most droplet discharge devices comprise a liquid storage chamber, a pressure chamber, a nozzle, an actuator, and a driver. The liquid storage chamber is connected to the nozzle via the pressure chamber, and liquid is supplied from the liquid storage chamber to the nozzle via the pressure chamber. The actuator is disposed in a position that corresponds to the pressure chamber, and applies pressure to the liquid inside the pressure chamber when the actuator receives a signal. The driver will transmit the signal to the actuator.

When the driver transmits the signal to the actuator for applying pressure to the liquid inside the pressure chamber, a pressure wave is generated inside the pressure chamber, and the generated pressure wave propagates a passage connecting the pressure chamber and the liquid storage chamber and a passage connecting the pressure chamber and the nozzle. The pressure wave that propagates the passages will be reflected toward the pressure chamber. Due to the reflection of the pressure wave, the pressure of the liquid inside the pressure chamber will periodically change. This period is equivalent to a period for the pressure wave to reciprocate once in the passage that connects the liquid storage chamber and the nozzle via the pressure chamber. That period will be hereinafter referred to as the cycle time of the pressure wave.

A droplet discharge device that sequentially discharges a plurality of droplets has been developed. In this type of droplet discharge device, the timing is synchronized so that the signal for applying pressure to the liquid inside the pressure chamber is applied to the actuator when the pressure inside the pressure chamber reaches a peak due to the periodical change of the pressure within the pressure chamber. By synchronizing the application of the signals to the actuator with the point at which the pressure inside the pressure chamber reaches the peak, high discharge efficiency can be obtained.

In addition, a droplet discharge device is known that will sequentially discharge a plurality of droplets to a target position. With this type of droplet discharge device, the driver will transmit 1 or a plurality of signals to the actuator during a period for discharging the plurality of droplets toward the target position. By selecting a number of signals that the driver will transmit to the actuator during the period, the amount of liquid that will adhere to the target position can be adjusted. If the droplet discharge device is an ink jet head, and one ink droplet prints a small dot, the ink jet head can print a small dot by discharging one ink droplet to the target position and can also print a large dot by discharging a plurality of ink droplets to the target position. An ink jet printer that can perform gray-scale printing can be achieved.

A droplet discharge device is known in which these technologies are combined. The driver of this type of droplet discharge device will transmit 1 or the plurality of signals within the period for printing one dot. When the driver transmits the plurality of signals with intervals, each interval is selected to be equal to the cycle time of the pressure wave. Therefore, high discharge efficiency will be obtained for printing the dot.

FIG. 13 shows a sample of the signals for discharging the plurality of droplets toward the target position. When the pulse signal is applied to the actuator, the actuator applies pressure to the liquid within the pressure chamber at the trailing edge of the pulse signal charging from low voltage to high voltage. When the interval between the signals is equal to 2AL which is the cycle time of the pressure wave, the actuator applies pressure at timing when the pressure within the pressure chamber becomes a peak.

FIG. 14 shows sequential patterns PA-PD of the signals that the driver of this type of droplet discharge device will transmit during the period for printing one dot. The driver will select one of the sequential patterns PA-PD, and will transmit 1 or the plurality of pulse signals in accordance with the selected sequential pattern. In FIG. 14, "o" indicates timing when the signal will be transmitted, and "x" indicates timing when no signal will be transmitted. Not transmitting a signal is equivalent to transmitting a null signal.

"Pe" in FIG. 14 shows the period in which the plurality of droplets will be discharged to the target position for printing one dot. "t1, t2, t3" of FIG. 14 are potential timings. "T" of FIG. 14 is the cycle time of the pressure wave. The consecutive potential tidings t1 and t2 are separated by the cycle time T of the pressure wave, and the consecutive potential timings t2 and t3 are separated by the cycle time T of the pressure wave.

In this situation, when the signal for applying pressure is applied to the actuator at the potential timing t1, the pressure wave will reach the peak at the subsequent potential timing t2, and thus when the subsequent signal for applying pressure is applied to the actuator at the potential timing t2, high discharge efficiency can be obtained. Likewise, when the signal for applying pressure is applied to the actuator at the potential timing t2, the pressure wave will reach the peak at the potential timing t3, and thus when the subsequent signal for applying pressure is applied to the actuator at the potential timing t3, high discharge efficiency can be obtained.

The sequential pattern PA in FIG. 14 is a pattern when droplets will not be discharged toward the target position, and pulse signals will not be transmitted. Droplets will not be discharged from the nozzle.

The sequential pattern PB is a pattern when one droplet will be discharged to the target position, and a pulse signal will be transmitted only once. In this situation, a pulse signal will be transmitted only once at the initial potential timing (t1), but a pulse signal may be transmitted only once at the second potential timing (t2) or the third potential timing (t3).

The sequential pattern PC is a pattern when two droplets will be discharged to the target position, and a pulse signal will be transmitted twice. In this situation, consecutive two pulse signals will be transmitted at the initial potential timing (t1) and the second potential timing (t2). When consecutive pulse signals are transmitted at an interval that is equal to the cycle time of the pressure wave, the second pulse signal will be applied to the actuator at which the pressure wave reaches the peak, and high discharge efficiency can be obtained. The consecutive two pulse signals may also be transmitted at the second potential timing (t2) and the third potential timing (t3). In this situation as well, the pulse signal at the timing t3 will be applied when the pressure wave will reach the peak pressure and high discharge efficiency can be obtained.

The sequential pattern PD is a pattern when three droplets will be discharged to the target position, and a pulse signal will be transmitted three times. In this situation, consecutive three pulse signals will be transmitted at potential timings t1, t2 and t3. The intervals between the timings t1 and t2 and the timings t2 and t3 are equal to the cycle time of the pressure wave. The pulse signal at the timings t2 and t3 will be applied when the pressure wave will reach the peak pressure and high discharge efficiency can be obtained.

The sequential patterns PA-PD of FIG. 14 are prepared in accordance with the following conditions.

(1) the plurality of potential timings (t1, t2, t3) will be present within the period (Pe) in which the plurality of droplets are discharged to the target position;

(2) the consecutive potential timings (t1, t2, t3) are divided by the cycle time (T) of the pressure wave that is generated inside the pressure chamber by transmitting the pulse signal to the actuator;

(3) the pulse signal will not be transmitted at timing other than the potential timings (t1, t2, or t3). Although the transmission of the pulse signal at the potential timing does not necessarily occur, the transmission of the pulse signal will be limited to any of the potential timings. If less than three pulse signals are transmitted within the period Pe, the one or two pulse signals are preferentially transmitted at the prior potential timings.

(4) The number of pulse signals that will be transmitted within the aforementioned period (Pe) will vary depending on the amount of droplets that are to be discharged to the target position.

As described above, the sequential pattern of the pulse signals transmitted in accordance with the rules in the aforementioned (1) to (4) include a plurality of types, and when the sequential pattern of the pulse signals is selected based upon the quantity of droplets to be discharged to the target position, the quantity of droplets to be discharged to the target position can be changed, and moreover, high discharge efficiency can be obtained. If this technology is applied to an ink jet head, it will be possible to change the size of each dot, and the ink jet printer in which gray-scale printing is possible can be achieved.

BRIEF SUMMARY OF THE INVENTION

As noted above, when the plurality of signals are transmitted with the interval being equal to the cycle time of the pressure wave, pressure can be efficiently applied to the liquid inside the pressure chamber. However, it was found that there are times in which the droplet is unwillingly discharged while the plurality of signals are consecutively transmitted with the interval. After examining this problem, the present inventors discovered that when the number of consecutive signals is excessive, excessive pressure will be generated within the pressure chamber and this excessive pressure causes problems.

FIG. 11(*f*) is a simulation result of the changes in the pressure of the liquid inside the pressure chamber when the driver has sequentially transmitted a plurality of signals Pb1, Pb2, and Pb3. The solid line indicates a sequence of signals transmitted by the driver, the vertical axis indicates the electric potential, and the horizontal axis indicates the elapsed time. When the driver changes the potential applied to the actuator from low voltage to high voltage, the actuator will apply pressure to the liquid inside the pressure chamber. With this droplet discharge device, the cycle time of the pressure wave will be approximately 12 μs. The signals Pb1, Pb2, Pb3 are transmitted at 12 μs time intervals. The dotted line of FIG. 11(*f*) indicates the pressure of the liquid inside the pressure chamber, and the vertical axis indicates the amount of pressure.

As shown in FIG. 11(*f*), when the driver transmits a first signal Pb1 at t1, the pressure wave generated by the first signal Pb1 will return to the pressure chamber 12 μs thereafter, therefore, the pressure of the pressure chamber will reach a peak 12 μs thereafter (at t2). Because the driver will transmit second signal Pb2 at that timing t2, the liquid inside the pressure chamber will be efficiently pressurized. When the driver transmits the signal Pb2 at the timing t2 at which the pressure of the pressure chamber reaches the peak, the pressure wave will return to the pressure chamber 12 μs thereafter, and thus the pressure of the pressure chamber will reach the peak 12 μs thereafter (at t3). It is clear that if the signal is applied at the timing t3, the peak pressure developed at t3 will be extremely high.

When the pressure of the liquid inside the pressure chamber becomes too high various types of problems will occur. For example, when a large pressure wave reaches the nozzle, liquid will leak out from the nozzle. When the liquid leaks from the nozzle, the leaked liquid will adhere around the periphery of the nozzle. When this occurs, the discharge quantity, discharge direction, and discharge speed of the next droplet discharged from the nozzle will change due to the adhered liquid. Thus, when the pressure of the liquid inside the pressure chamber becomes too high, various types of problems will occur.

In the present invention, a droplet discharge device will be provided that can efficiently pressurize the liquid in a range in which the pressure of the liquid inside the pressure chamber will not become too high, and will sequentially discharge a plurality of droplets from the nozzle efficiently without problems.

In the present invention, a driver will be provided that will efficiently pressurize the liquid in the range in which the pressure of the liquid inside the droplet discharge device will not become too large.

In the present invention, a drive method will be provided that will efficiently pressurize the liquid in the range in which the pressure of the liquid inside the droplet discharge device will not become too large.

A droplet discharge device of the present teachings comprises a pressure chamber storing liquid to be discharged, an actuator applying pressure to the liquid within the pressure chamber when the actuator receives a signal, a nozzle connected to the pressure chamber and discharging a droplet when the actuator receives the signal. A driver of the present teachings transmits the signals sequentially within a period of discharging droplets to a target position to the actuator under the following conditions:

(1) the signals are transmitted sequentially at intervals, the interval being substantially equal to a product of an integer and a cycle time of a pressure wave generated within the pressure chamber by applying the signal to the actuator, wherein the integer is one or more; and (2) in a case that a number of the signals transmitted to the actuator within the period is equal to or more than a predetermined number, at least one interval is substantially equal to a product of an integer and the cycle time, wherein the integer is two or more.

With this droplet discharge device, consecutive signals will be transmitted at the interval being substantially equal to the cycle time of the pressure wave. That means that the consecutive signals will be transmitted in association with the cycle time of the pressure wave, and thus the liquid inside the pressure chamber will be efficiently pressurized.

In addition, according to the condition (2), the pressure of the liquid inside the pressure chamber will be prevented from becoming too high. Due to this, the occurrence of problems such as the leakage of liquid from the nozzle can be avoided.

A driver of the present teachings includes a signal transmitter that transmits signals sequentially under the following conditions:

(1) the signals are transmitted sequentially at intervals, the interval being substantially equal to a product of the integer and the cycle time of the pressure wave generated within the pressure chamber by applying the signal to the actuator, wherein the integer is one or more; and (2) in a case that the number of the signals transmitted to the actuator within the period is equal to or more than the predetermined number, at least one interval is substantially equal to a product of the integer and the cycle time, wherein the integer is two or more.

A method of the present teachings includes steps of inputting an amount of liquid to be discharged to the target position, storing the plurality of sequential patterns of signals, selecting one of the sequential patterns depending the inputted amount, and transmitting signals according to the selected sequential pattern to the actuator for discharging droplets sequentially from the droplet discharge device toward the target position. The sequential patterns of pulse signals are prepared by the following conditions:

(1) the signals are transmitted sequentially at intervals, the interval being substantially equal to a product of the integer and the cycle time of the pressure wave generated within the pressure chamber by applying the signal to the actuator, wherein the integer is one or more; and (2) in a case that the number of the signals transmitted to the actuator within the period is equal to or more than the predetermined number, at least one interval is substantially equal to the product of the integer and the cycle time, wherein the integer is two or more.

The aforementioned drive method will transmit a pulse signal at one of potential timings that are set to match the cycle time of the pressure wave. In addition, consecutive pulse signals that exceed the predetermined number will not be transmitted. The intended quantity of liquid can be adhered to the target position. In addition, the pressure of the liquid inside the pressure chamber will be prevented from becoming too high. Furthermore, the pressure of the liquid inside the pressure chamber can be efficiently increased in a range that will not make the pressure of the liquid inside the pressure chamber excessive.

BRIEF DESCRIPTION OF THE DRAWINGS

FIG. 6(*b*) is a plan view of an individual electrode and a land portion.

FIG. 7(*b*) is a waveform of a drive signal that corresponds to a medium dot.

FIG. 7(*c*) is a waveform of a drive signal that corresponds to a large dot.

FIG. 11(*b*) shows the pressure variation in a pressure chamber when the drive signal of FIG. 7(*b*) was applied.

FIG. 11(*c*) shows the pressure variation in a pressure chamber when the drive signal of FIG. 7(*c*) was applied.

FIG. 11(*d*) shows the pressure variation in a pressure chamber when the drive signal of FIG. 8 was applied.

FIG. 11(*e*) shows the pressure variation in a pressure chamber when the drive signal of FIG. 9 was applied.

FIG. 11(*f*) shows the pressure variations in a pressure chamber when three drive pulses are consecutively applied at a time interval of 2AL.

DETAILED DESCRIPTION OF THE INVENTION

Figure 1:
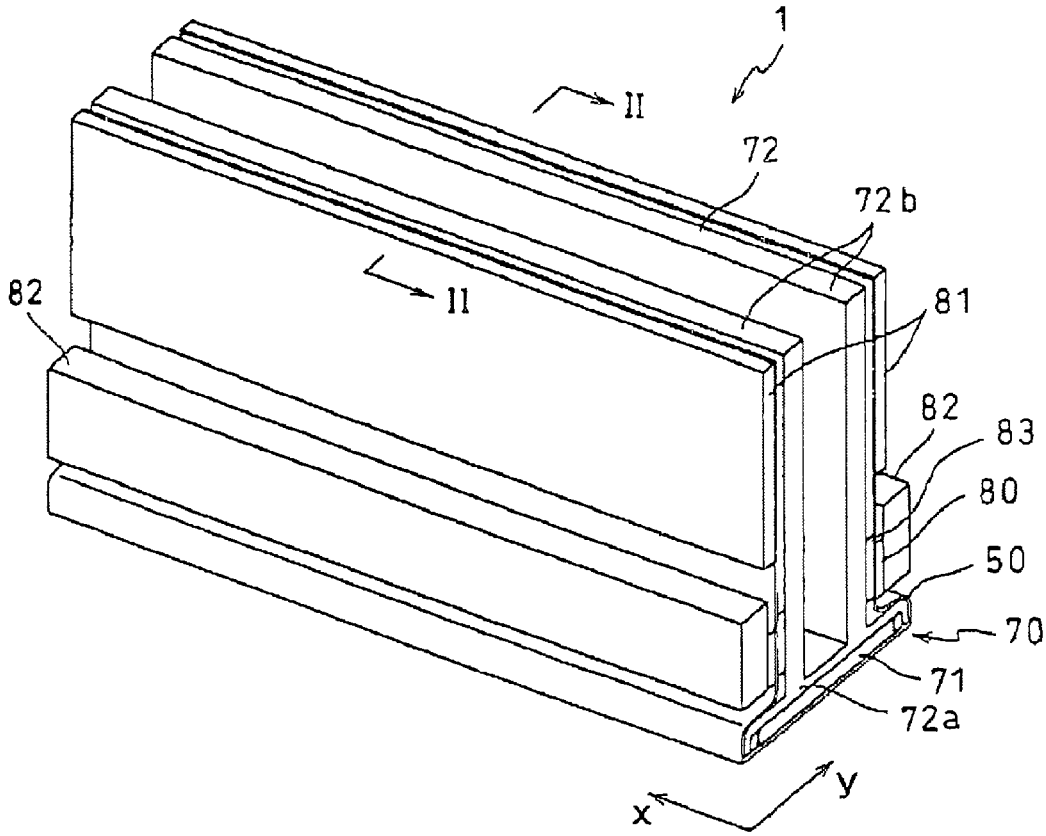
FIG. 1 is an oblique view of an ink jet head according to an embodiment of the present invention.
Figure 2:
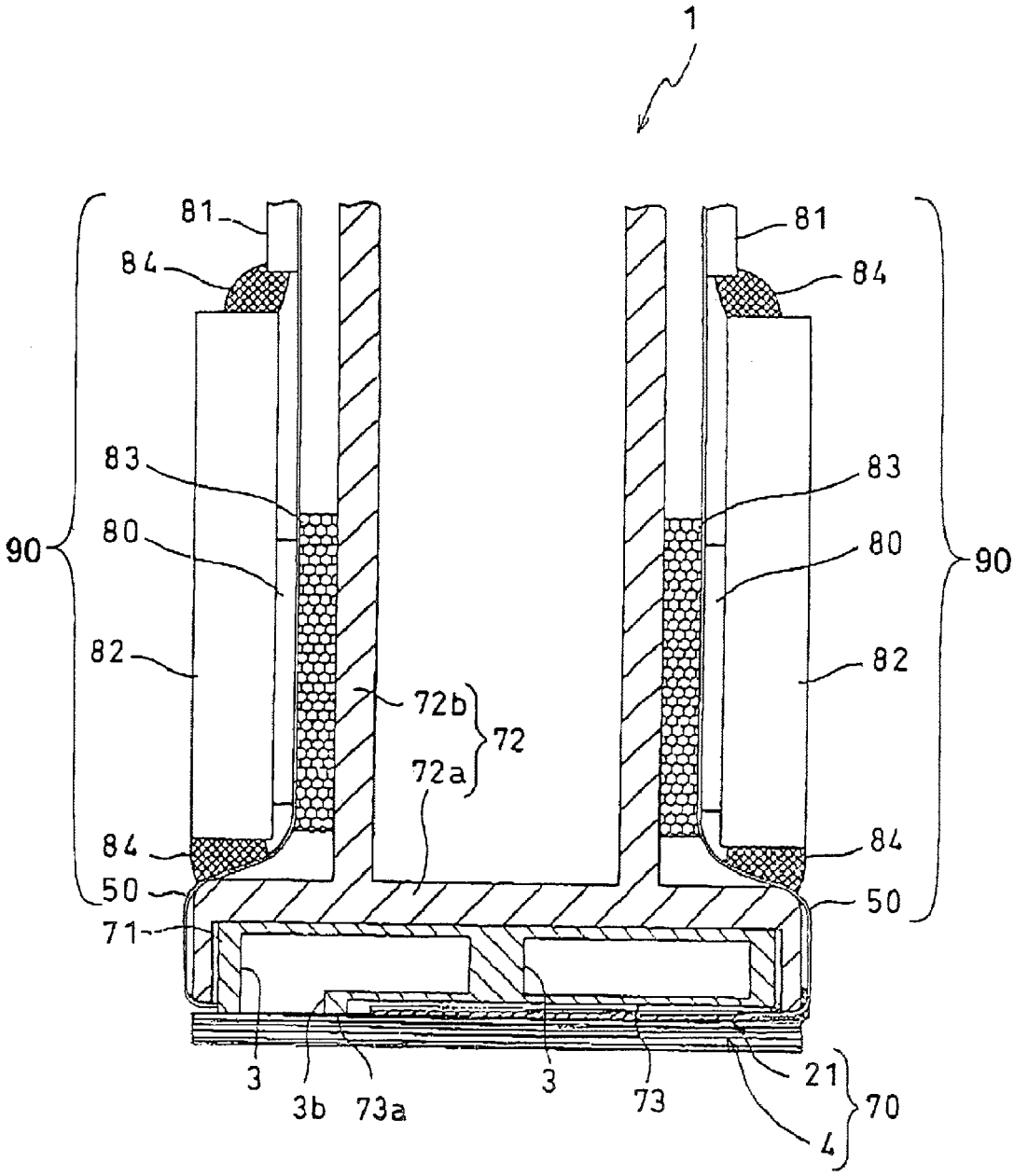
FIG. 2 is a cross-sectional view taken along line II-II of FIG. 1.

A preferred embodiment of the present invention will now be described with reference to the drawings. FIG. 1 shows a schematic perspective view of ink jet head module 1 of the present invention. FIG. 2 shows a cross-sectional view taken along the line II-II of FIG. 1. Ink jet head module 1 is incorporated in a printing device (an ink jet printer in the present embodiment), and prints on a paper by discharging ink droplets towards the paper being conveyed in a secondary operating direction (the y direction in FIG. 1). Ink jet head module 1 extends in a widthwise direction of the paper (the x direction of FIG. 1), and can print by discharging ink droplets onto desired positions in the widthwise direction of the paper.

Ink jet head module 1 is composed of ink jet head 70 for discharging ink droplets onto the paper, base block 71 for supplying ink to ink jet head 70, holder 72 to which ink jet head 70 and base block 71 are fixed, and wirings 90 (see FIG. 2) for supplying electrical signals to ink jet head 70.

Holder 72 is provided with grip portion 72*a*, and a pair of flat plate-shaped protruding portions 72*b* that extend in a perpendicular direction from grip portion 72*a*. As shown in FIG. 2, a lower face of grip portion 72*a* is formed in a concave shape. Base block 71 is fixed within the concave part of grip portion 72*a*. Ink jet head 70 is fixed to a lower side of base block 71. Wirings 90 are disposed on both outer side faces of two protruding portions 72*b*.

Base block 71 is fixed within the concave part formed at the lower face of grip portion 72*a*. Base block 71 is formed from stainless steel, and two ink reservoirs 3 are formed within base block 71. Ink reservoirs 3 are substantially rectangular parallelepiped shaped hollow regions that are formed along the lengthwise direction (the x direction of FIG. 1) of base block 71. Base block 71 has a passage (not shown) for leading ink supplied from an ink tank disposed at the exterior to ink reservoirs 3. Ten penetrating holes 3*b* are formed in lower face 73 of base block 71. Ten penetrating holes 3*b* communicate with ink reservoirs 3. Neighboring portion 73*a* of each of penetrating holes 3*b* protrudes downwards below other parts of lower face 73.

Ink jet head 70 is fixed to base block 71 such that the upper face of ink jet head 70 faces lower face 73 of base block 71. Ten penetrating holes 5*b* are formed in positions facing ten openings 3*b* formed in base block 71. Neighboring portions 73*a* that protrude downward near penetrating holes 3*b* of base block 71 make contact with portions neighboring openings 5*b* of ink jet head 70.

A plurality of manifolds 5 (to be described) are formed within ink jet head 70. Openings 5*b* of ink jet head 70 communicate with manifolds 5. The ink supplied from the ink tank is supplied to manifolds 5 of ink jet head 70 via ink reservoirs 3, penetrating holes 3*b*, and openings 5*b*.

Figure 15:
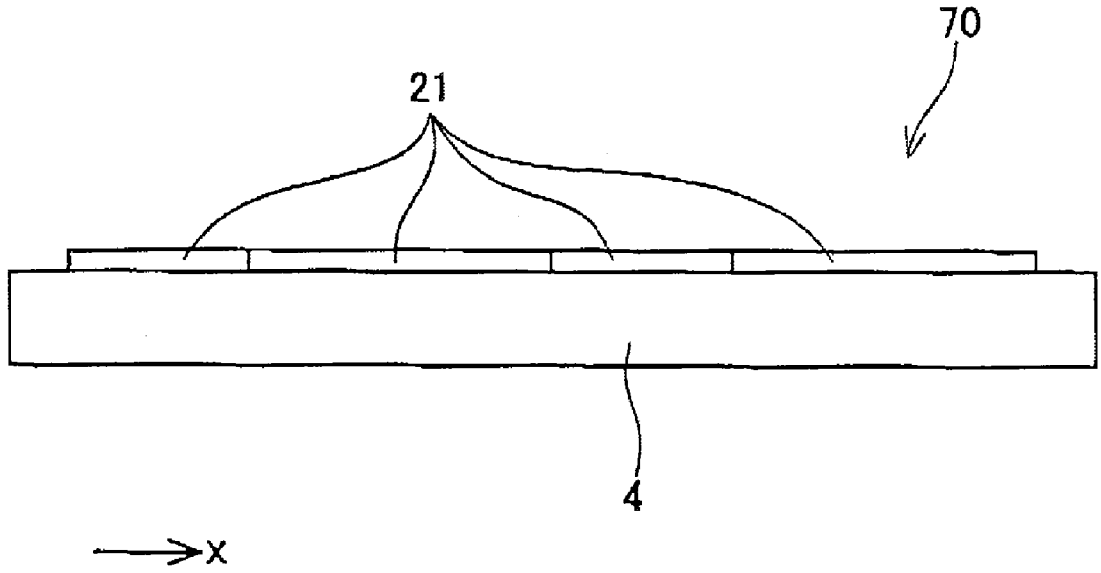
FIG. 15 is a front view of an ink jet head according to an embodiment of the present invention.
Figure 16:
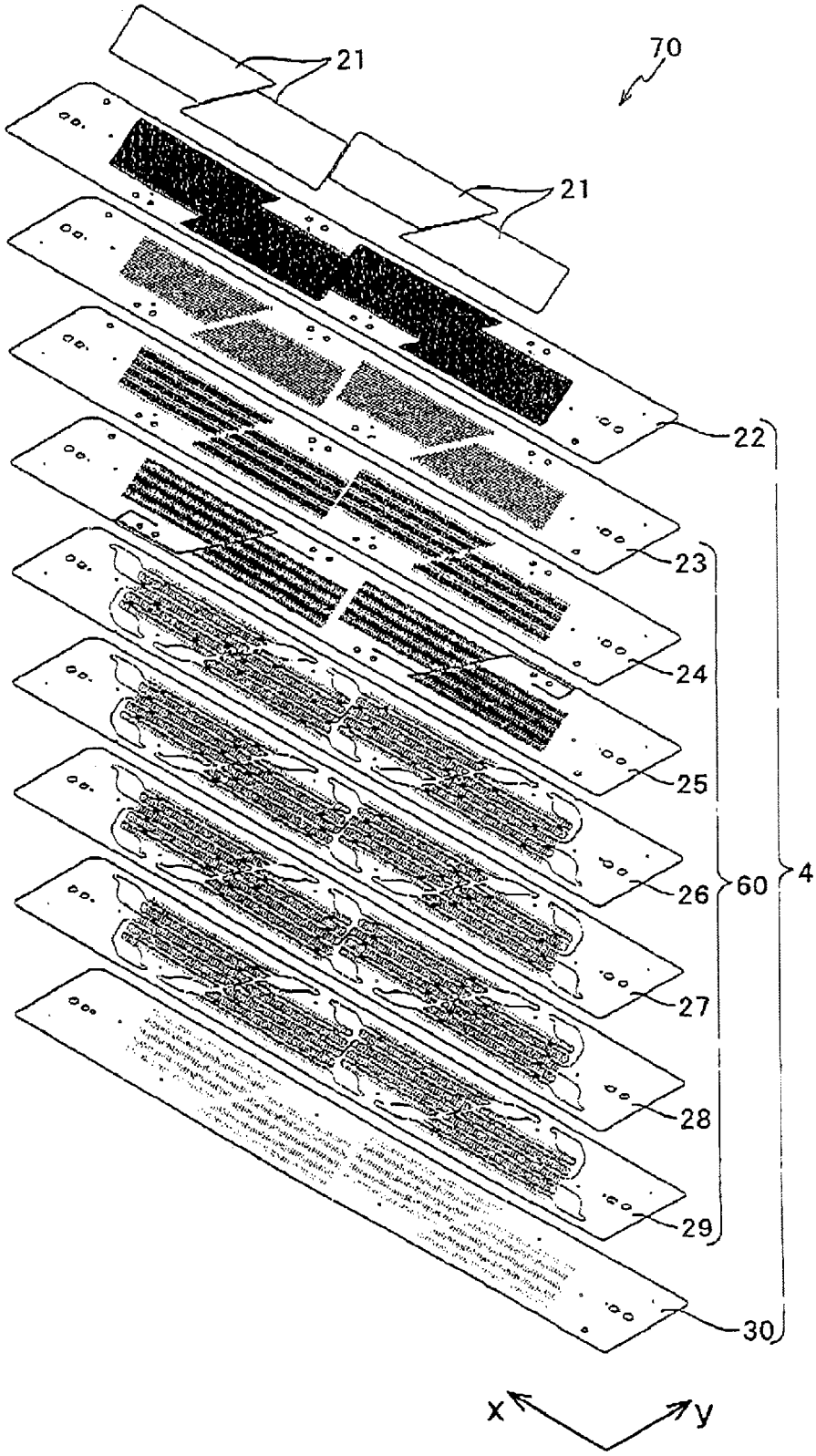
FIG. 16 is an exploded oblique view of an ink jet head according to an embodiment of the present invention.

Ink jet head 70 is fixed to lower face 73 of base block 71. FIG. 15 shows a front view of ink jet head 70. As shown in FIG. 15 and FIG. 16, ink jet head 70 is composed of one passage unit 4 and four actuator units 21.

FIG. 16 is a disassembled perspective view of ink jet head 70. As shown in FIG. 16, passage unit 4 is composed of metal plates 22~29 and nozzle plate 30 that have been stacked. Metal plates 22~29 and nozzle plate 30 are metal plates formed from stainless steel or the like. That is, nozzle plate 30 is also a type of metal plate. A plurality of penetrating holes are formed in each of metal plates 22~29 and nozzle plate 30.

Figure 3:
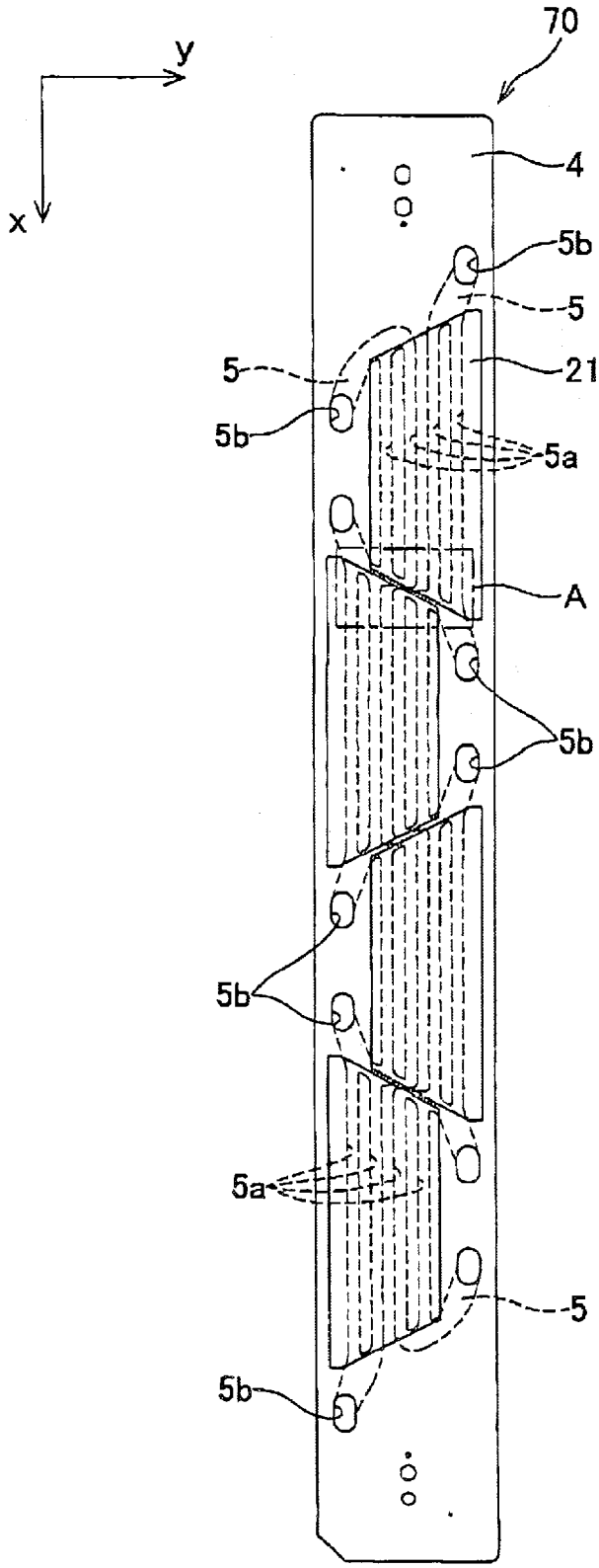
FIG. 3 is a plan view of a head unit

FIG. 3 shows a plan view of ink jet head 70. As shown in FIG. 3, ten manifolds 5 are formed from the penetrating holes formed in metal plates 22~29 and nozzle plate 30 within passage unit 4. One end of each of manifolds 5 opens into the upper face of ink jet head 70 (i.e. the upper face of metal plate 22) at a location that does not interfere with actuator units 21. The other end of each of manifolds 5 branches to form sub-manifolds 5*a*. As described above, ink is supplied from ink reservoirs 3 of base block 71 to openings 5*b* of manifolds 5. The ink supplied to manifolds 5 is supplied into sub-manifolds 5*a*.

Figure 5:
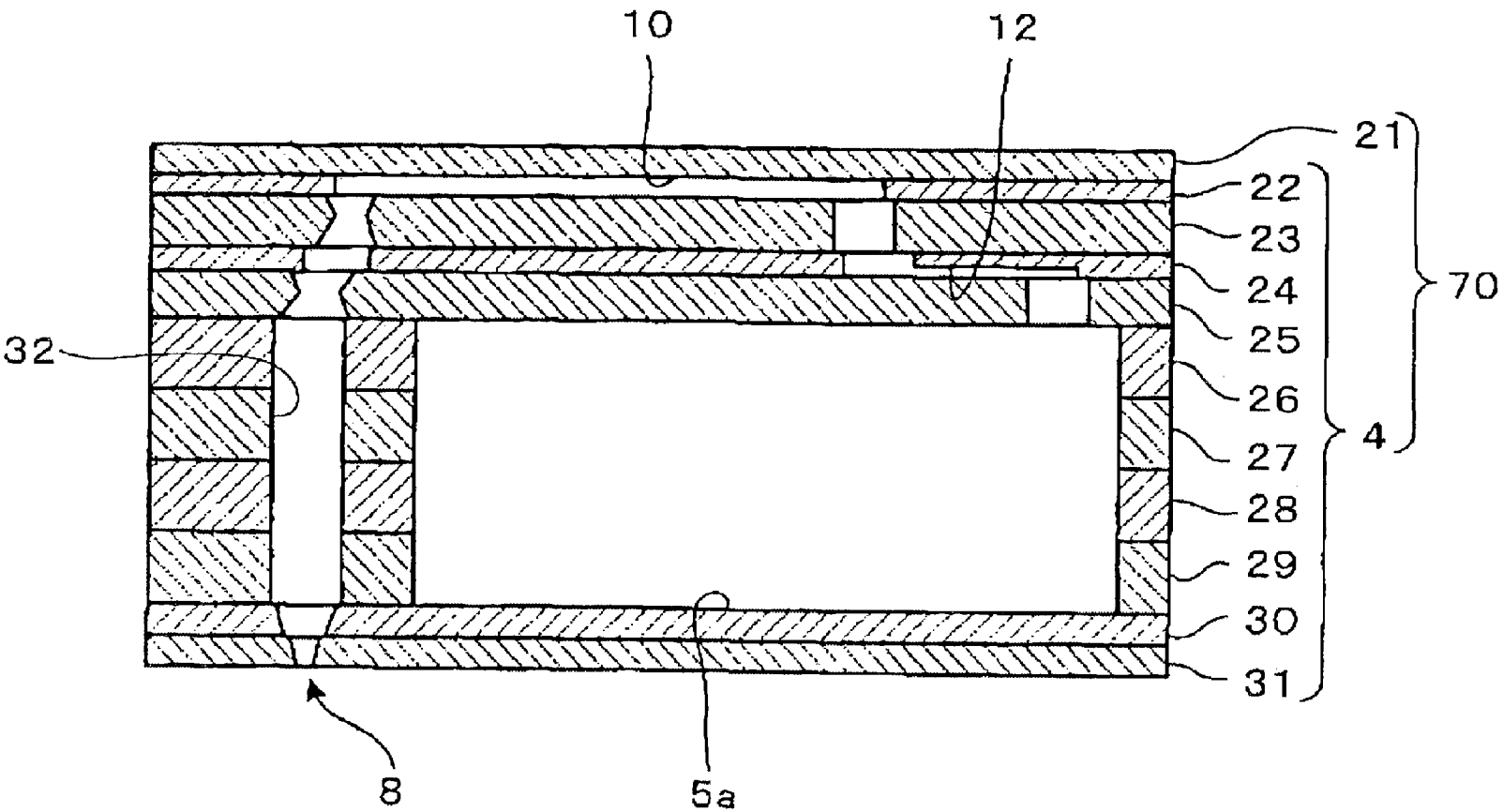
FIG. 5 is a cross-sectional view taken along line V-V of FIG. 4

FIG. 5 is a cross-sectional view of ink jet head 70, and is an enlarged schematic view of one ink discharging path (a branching passage that has branched into a pressure chamber and a nozzle). As shown in FIG. 5, branching passage 32 is formed from the penetrating holes formed in metal plates 22~29 and nozzle plate 30 within passage unit 4. One end of each of branching passages 32 is connected with sub-manifolds 5*a* (the common passage), and the other end thereof is connected with corresponding nozzle 8. Branching passages 32 receive the ink supplied from sub-manifolds 5*a*, and lead this ink to nozzles 8. Nozzles 8 open into the lower face of nozzle plate 30, and discharge the ink supplied from branching passages 32. Pressure chamber 10 is formed part-way along branching passage 32. Pressure chamber 10 is formed substantially in the center of branching passage 32.

Pressure chamber 10 is formed from a penetrating hole formed in metal plate 22, and is covered by actuator unit 21. Pressure chamber 10 is filled with the ink that was supplied from sub manifold 5*a* via an upstream portion of branching passage 32. Aperture 12 is formed in branching passage 32 at the side upstream from pressure chamber 10.

Figure 6:
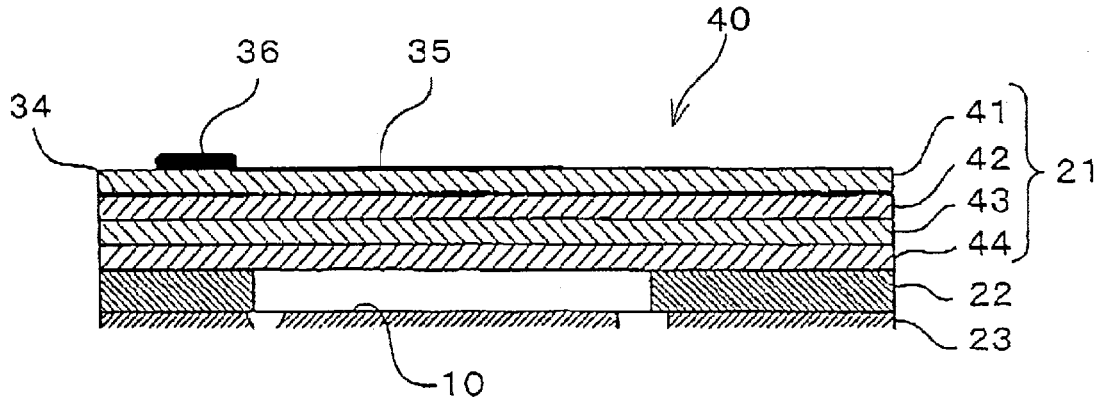
FIG. 6(*a*) is a partial enlarged cross-sectional view of an actuator unit.
Figure 6:
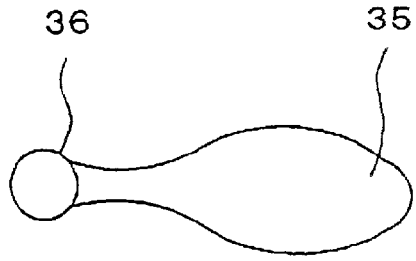

As shown in FIG. 6(*a*), actuator units 21 are fixed to the upper face of top metal plate 22 of passage unit 4. Each actuator units 21 is composed of four ceramic plates 41~44. Ceramic plates 41~44 are formed from ferroelectric ceramic material. In the present embodiment, they are formed from lead zirconate titanate (PZT) ceramic material. Ceramic plates 41 are polarized in their direction of thickness. Further, the thickness of each of ceramic plates is 15 μm.

Individual electrodes 35 are formed on an upper face of ceramic plate 41 at locations directly above pressure chambers 10 of passage unit 4. Individual electrodes 35 are formed from Ag—Pd metal. Further, as shown in FIG. 6 (*b*), individual electrodes 35 are substantially diamond shaped, and one portion thereof extends outwards. Land 36 is formed at this extending portion. Lands 36 are circular, have a diameter of approximately 160 μm, and are composed of gold that contains glass flit. Lands 36 are electrically connected with wiring pattern of FPC 50 (to be described).

Common electrode 34 is formed across approximately the entire face between ceramic plate 41 and ceramic plate 42. Common electrode 34 is grounded at a location not shown in the figures. Common electrode 34 is formed from Ag—Pd metal.

Figure 4:
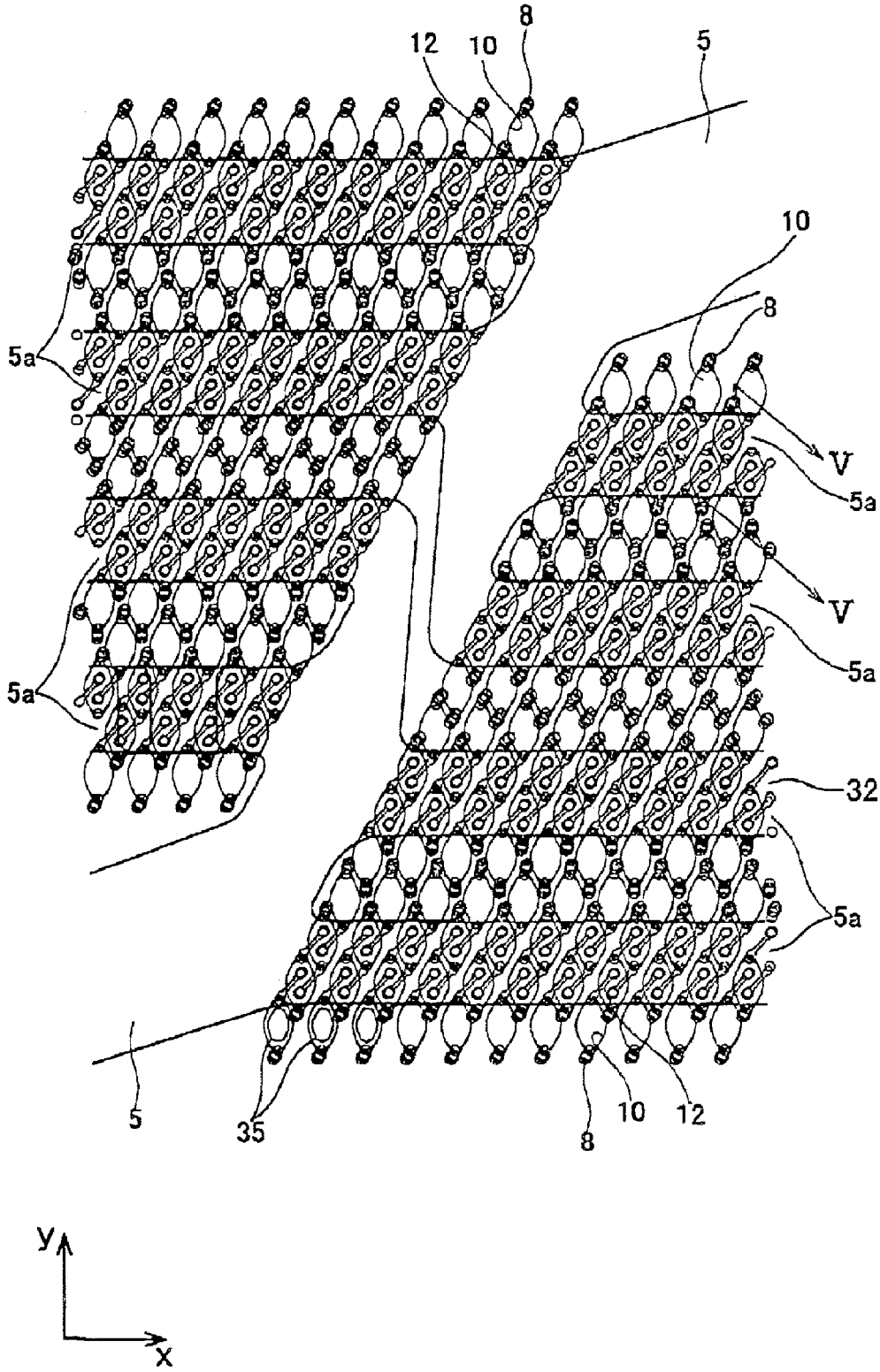
FIG. 4 is an enlarged view of the area "A" of FIG. 3.

FIG. 4 shows an expanded view of a region "A" of FIG. 3. The passage within passage unit 4 is shown by a solid line. As shown in FIG. 4, a plurality of branching passages 32 is formed within passage unit 4. These branching passages 32 extend from sub-manifolds 5*a* to nozzles 8 via apertures 12 and pressure chambers 10. Branching passages 32 are formed in a matrix shape. Manifolds 5 and sub-manifolds 5*a* are formed within passage unit 4 for supplying ink to matrix-shaped branching passages 32. Further, the reference numbers 35 in FIG. 4 represent individual electrodes 35 of actuator units 21. That is, individual electrodes 35 are formed at locations directly above each pressure chambers 10 on an upper face of actuator unit 21. In order for this to be shown more clearly, only some of individual electrodes 35 have been shown in FIG. 4. However, individual electrodes 35 are actually formed directly above all pressure chambers 10.

One actuator 40 is formed from one individual electrode 35, portion of ceramic plates 41, 42, 43, and 44 facing individual electrode 35, and common electrode 34 facing individual electrode 35. Each actuator unit 21 includes a plurality of actuators.

As shown in FIG. 2, each of wirings 90 has FPC 50 (Flexible Printed Circuit), driver IC 80, base plate 81, and heat sink 82. FPC 50 is disposed along holder 72 via resilient member 83 such as a sponge or the like. A lower edge of FPC 50 extends into a space formed between lower face 73 of base block 71 and the upper face of ink jet head 70, and is fixed to the upper face of ink jet head 70. More precisely, the lower edge of FPC 50 is fixed to the upper face of actuator unit 21. A plurality of wirings are formed in FPC 50, and a terminal is formed at a lower edge of each wiring. A plurality of lands 36 is formed on the upper face of actuator unit 21. The distribution pattern of the terminals of FPC 50 is identical with the distribution pattern of lands 36 of actuator unit 21, and when the lower edge of FPC 50 is fixed to the upper face of actuator unit 21, the wirings are connected with corresponding lands 36. Driver IC 80 is disposed part-way along FPC 50. Each output terminal of driver IC 80 is electrically connected with the wiring formed on FPC 50. Heat sink 82 is fixed to a surface of driver IC 80. Heat sink 82 prevents a temperature rise of driver IC 80. Sealing member 84 is provided around heat sink 82 to prevent dust or ink within ink jet head module 1 from entering therein.

Base plate 81 is fixed to the outer faces of two protruding portions 72*b* of holder 72. Base plate 81 is electrically connected with the wiring near an upper edge of FPC 50. That is, base plate 81, driver IC 80 and actuator unit 21 are electrically connected by FPC 50.

Figure 12:
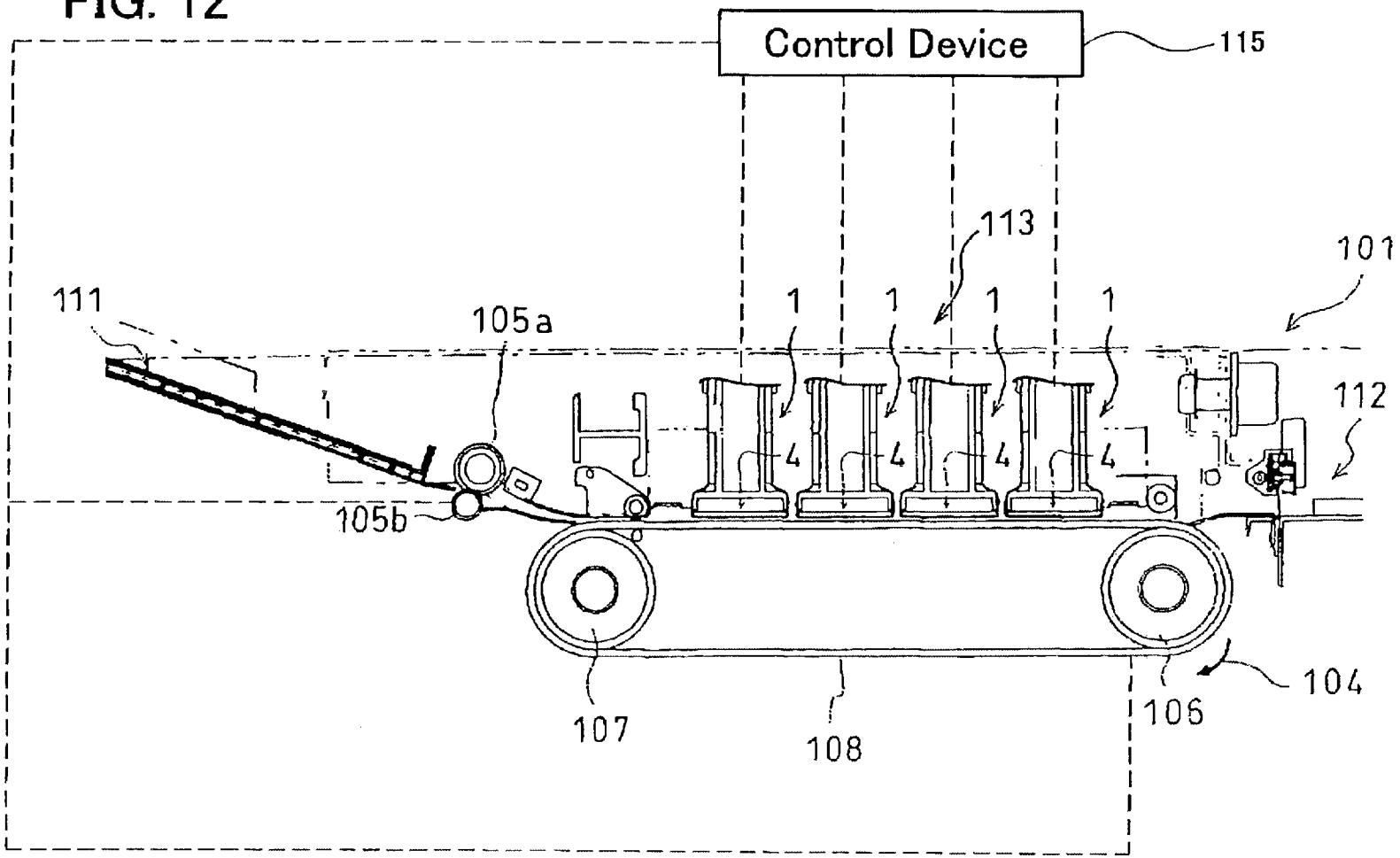
FIG. 12 is a schematic view of an ink jet printer according to an embodiment of the present invention.

The ink jet head module noted above is mounted and used in ink jet printer 101 shown in FIG. 12. Ink jet printer 101 is constructed by an image forming unit 113 that prints images and the like on paper, a paper supply unit 111 in which paper that prints images and the like is disposed, a paper discharge unit 112 that receives paper on which images and the like were printed, and a control device 115. Paper supply unit 111 is connected to the lateral surface of image forming unit 113. Paper discharge unit 112 is also connected to the lateral surface of the image forming unit 113, and is connected at a point on the opposite side of the point at which the paper supply unit 111 is connected. Control device 115 is electrically connected to image forming unit 113.

Image forming unit 113 comprises four ink jet head modules 1, two belt rollers 106, 107, a transport belt 108, and feed rollers 105*a*, 105*b*.

The feed rollers 105*a*, 105*b* can be rotated around rotation shafts. Feed rollers 105*a* and 105*b* are designed such that the rotation shafts thereof are mutually parallel, and are disposed to be in mutual contact. Feed rollers 105*a* and 105*b* comprise a motor. In addition, feed rollers 105*a* and 105*b* are electrically connected to control unit 115. Feed rollers 105*a* and 105*b* will rotate in response to command control values transmitted by control device 115. In addition, an end surface of paper supply unit 111 is connected to the point at which the feed rollers 105*a* and 105*b* are located. Feed rollers 105*a* and 105*b* will sandwich a sheet of paper disposed in paper supply unit 111 therebetween, and transport it downstream (the right side in the drawing).

Belt rollers 106, 107 are rotatably disposed around rotation shafts on the downstream side of feed rollers 105*a* and 105*b*. Belt rollers 106, 107 are mutually spaced and disposed such that the rotation shafts of each are parallel. Belt roller 106 comprises a motor. In addition, belt roller 106 is electrically connected to control device 115. Belt roller 106 will rotate in the direction of arrow 104 in response to a control command signal transmitted by control device 115. Transport belt 108 is extended around belt rollers 106, 107. The outer peripheral surface of transport belt 108 is subjected to a silicone treatment. When belt roller 106 is driven by the motor and rotated, transport belt 108 will move around belt rollers 106, 107 by means of rotation. In addition, belt roller 107 will rotate in accordance with the movement of transport belt 108. In other words, the portion on the upper side of transport belt 108 will move to the right in the drawing, and the portion on the lower side thereof will move to the left in the drawing. Transport belt 108 will move paper that has been placed on the upper surface thereof, and will transport that paper downstream.

The end portion of paper discharge unit 112 is connected to the downstream side of transport belt 108. The paper transported by transport belt 108 will be received by paper discharge unit 112.

Four ink jet head modules 1 are disposed on the upper portion of the transport belt 108 so that the lower surfaces thereof are opposite the upper surface of transport belt 108. A gap is formed between the lower surface of ink jet head modules 1 and the upper surface of transport belt 108. Paper transported by transport belt 108 will be transported through that gap. In addition, the length in the lengthwise direction of ink jet head modules 1 is equal to the width of the paper to be transported. In addition, each of the four ink jet head modules 1 discharge ink of a different color. The color of the ink that ink jet head modules 1 discharge is, from the left of the drawing, magenta, yellow, cyan, and black.

Control device 115 is electrically connected to feed rollers 105*a* and 105*b*, each motor that drives belt roller 106, and base plate 81 of each ink jet head module 1. Control device 115 will transmit control command to them.

The operation of ink jet printer 101 during printing will be described next. During printing, paper will be stacked in paper supply unit 111. In addition, during printing, design data to be printed will be input to control device 115. When the design data is input, control device 115 will drive feed rollers 105*a* and 105*b* and belt roller 106.

When feed rollers 105*a* and 105*b* are driven by control device 115, one sheet of paper disposed in paper supply unit 111 will be sandwiched between feed rollers 105*a* and 105*b* due to rotation. By rotating feed rollers 105*a* and 105*b* in this way, the paper will be transported to the upper surface of transport belt 108.

When the paper is transported to the upper surface of transport belt 108, the paper will adhere to the silicone layer formed on the outer peripheral surface of the transport belt 108. Because transport belt 108 moves, the paper will be adhered to and transported by transport belt 108. When the paper is transported by transport belt 108, the paper will be transported in the gap between the ink jet head modules 1 and the transport belt 108. In other words, paper will be transported in the secondary scan direction (the y direction in FIG. 1) by transport belt 108 to the lower surface side of ink jet head modules 1.

In addition, based on the design data that was input to control device 115, control command will be transmitted to base plate 81 of each ink jet head module 1. The control command transmitted to each base plate 81 will be input to each driver IC 80 via FPC 50 connected to each. Each driver IC 80 will select whether or not an electrical signal is to be transmitted to each individual electrode 35 of actuator unit 21, based upon the input control command. Then, any of three types of electrical signals 91-93 (see FIG. 7) will be transmitted to individual electrodes 35.

When driver IC 80 transmits one electrical signal 91 to individual electrode 35, it will drive the corresponding actuator 40 once. When this occurs, one droplet of ink will be discharged from the corresponding nozzle 8. The ink droplet that was discharged will adhere to the paper at or near a target position, and a small dot will be printed at the target position on the paper. When driver IC 80 transmits two consecutive electrical signals 92 to individual electrode 35, two droplets of ink will be discharged from the corresponding nozzle 8. When this occurs, a medium sized dot will be formed by two droplets at or near the target position. When driver IC 80 transmits three electrical signals 93 to individual electrode 35, three droplets of ink will be discharged from the corresponding nozzle 8. When this occurs, a large dot will be formed by three droplets at or near the target position.

Two or three ink droplets discharged consecutively nay be merged while traveling toward the paper or may be merged on the paper. In the latter case, ink droplets may land on the same position on the paper or may land respectively on a bit shifted positions on the paper. In either case, one dot is formed by two or three ink droplets.

Because the interval of discharging consecutive droplets is extremely short with respect to paper moving speed, the paper may be transported while printing one dot by consecutive two or three ink droplets. It may be possible that the paper transportation may be stopped while printing one dot by consecutive two or three ink droplets.

Because the aforementioned operation will be performed by each of the four ink jet head modules 1, magenta, yellow, cyan, and black dots will be printed on the paper. When dots of each respective color are printed on the paper, a color design will be formed by means of these dots. Note that the design will be printed at a resolution of approximately 600 dpi in ink jet printer 101.

When the design is printed on the paper, the paper will be further transported by transport belt 108, and discharged to the paper discharge unit 112.

As noted above, with ink jet printer 101, control device 115 will transport the paper by means of transport belt 108, and each driver IC 80 will select whether or not an electrical signal will be transmitted to each individual electrode 35. In this way, the position in which dots are printed with respect to the vertical direction of the paper will be determined.

In addition each driver IC 80 will select a nozzle 8 to discharge ink by selecting an individual electrode 35 to transmit an electrical signal. In this way, the position in which dots are printed with respect to the horizontal direction of the paper will be determined.

In addition, each driver IC 80 will select the size of the dot to be printed by selecting a number of electrical signals to transmit to individual electrode 35 during a period of printing one dot from the electrical signals 91-93. The differences in the sizes of the dots will be the differences in the tint of the colors when viewing the entire printed design. In other words, the tint of the colors is determined by the number of ink droplets of forming the dot that is determined by the type of electrical signal transmitted by driver IC 80.

Because each driver IC will select the position in which the dot is to be printed and the size of that dot, the design will be printed on the paper based upon the design data.

Figure 7:
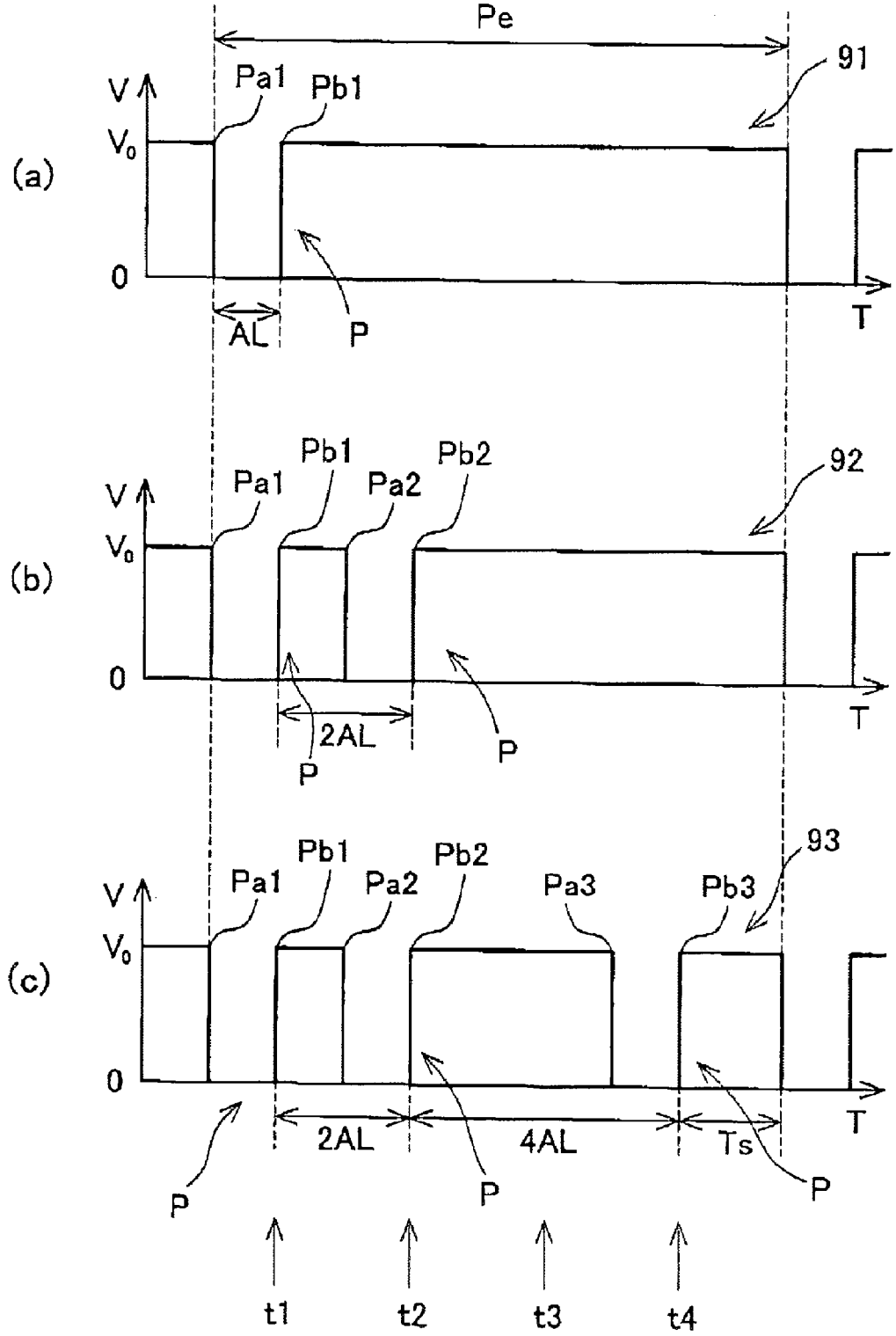
FIG. 7(*a*) is a waveform of a drive signal that corresponds to a small dot.

FIG. 7 shows a wave form of each of three types of electrical signals 91-93 that driver IC 80 outputs. As shown in FIG. 7, the electrical signals 91-93 are formed of a combination of pulse signals P. Each pulse signal P includes signal Pa changing from high voltage to low voltage and signal Pb changing from low voltage to high voltage. When signals Pa changing from high voltage to low voltage are applied to individual electrode 35, the volume of pressure chamber 10 is increased and the pressure within the pressure chamber 10 is decreased. When signals Pb changing from low voltage to high voltage are applied to individual electrode 35, the volume of pressure chamber 10 is decreased and the pressure within the pressure chamber 10 is increased. In FIG. 7, Pe indicates a period of printing one dot. There is provided a plurality of potential timings t1 to t4 within the period Pe for one dot printing. The consecutive potential timings are separated by 2AL that is equal to the cycle time of the pressure wave generated within the pressure chamber.

When signal Pa changing from high voltage to low voltage is applied to individual electrode 35, and the pressure within the pressure chamber 10 is decreased, and the pressure within the pressure chamber 10 is increased to a peak value when a half cycle time AL of the pressure wave has elapsed after the signal Pa was applied. The signal Pb changing from low voltage to high voltage is applied when the half cycle time AL of the pressure wave has elapsed after the signal Pa was applied. The signal Pb for increasing the pressure within the pressure chamber 10 is applied when the pressure is increased to the peak value due to the pressure wave. The signal Pa precedes the signal Pb by the half cycle time AL of the pressure wave, therefore, high discharge efficiency can be obtained.

When signal Pb for increasing the pressure is applied, the pressure within the pressure chamber 10 is decreased to a bottom value when the half cycle time AL of the pressure wave has elapsed after the signal Pb was applied. The signal Pa for decreasing the pressure is applied when the half cycle time AL of the pressure wave has elapsed after the signal Pb was applied. The signal Pa for decreasing the pressure is applied when the pressure is decreased to the bottom value due to the pressure wave. The signal Pb precedes the signal Pa by the half cycle time AL of the pressure wave, therefore, high suction efficiency can be obtained.

When signal Pb for increasing the pressure is applied, the pressure within the pressure chamber 10 is increased to a peak value when the cycle time 2AL of the pressure wave has elapsed after the signal Pb was applied. The subsequent signal Pb for increasing the pressure is applied when the cycle time 2AL of the pressure wave has elapsed after the signal Pb was applied. The signal Pb for increasing the pressure is applied when the pressure is increased to the peak value due to the pressure wave. High discharge efficiency can be obtained. The signal Pb precedes the subsequent signal Pb by the cycle time 2AL of the pressure wave, therefore, high discharge efficiency can be obtained.

With signal pattern 91, electric signal Pa1 will be transmitted at the initiation of period Pe of one dot printing, and after signal Pa1 is transmitted, signal Pb1 will be transmitted at first potential timing t1. The first potential timing t1 is late by AL from the signal Pa1. An electrical signal will not be transmitted at potential timings t2-t4. Not transmitting an electrical signal is equivalent to transmitting a null signal. In other words, with electrical signal pattern 91, a null signal will be transmitted at potential timings t2-t4. The dot will be formed from one ink droplet with signal pattern 91.

With signal pattern 92, electrical signals Pa1 and Pb1 will be transmitted at the same timing as signal pattern 91. After electrical signal Pb1 has been transmitted, electrical signal Pad will be transmitted after a predetermined time period AL, and electrical signal Pb2 will be output at second potential timing t2. A null signal will be transmitted at potential timings t3 and t4. The dot will be formed from two ink droplet with signal pattern 92.

With signal pattern 93, electrical signals Pa1, Pb1, Pa2, and Pb2 will be transmitted at the same timing as signal pattern 92. A null signal will be transmitted at third potential timing t3. After electrical signal Pb2 has been transmitted, electrical signal Pa3 will be transmitted after a predetermined time period AL, and electrical signal Pb3 will be output at potential timing t4. The dot will be formed from three ink droplet with signal pattern 93.

The consecutive signals Pb1, Pb2 for applying pressure is separated by 2AL which is the cycle time of the pressure wave. The signals Pb2 and Pb3 are not consecutive, because there is the null signal at the potential timing t3. The signals Pb2 and Pb3 are separated by 4AL which is the two times of the cycle time of the pressure wave.

When electrical signal patterns 91-93 are not being transmitted (prior to the initiation of one dot printing period Pe of FIGS. 7(*a*)-7(*c*)), the potential of individual electrode 35 will be maintained at $V_0$ by means of driver IC 80. In addition, common electrode 34 will be grounded. Thus, an electric field will be generated between individual electrode 35 and common electrode 34. In addition, ceramic plates 41 that form actuator unit 21 are comprised of a ferroelectric material, and the polar direction of ceramic plate 41 is the thickness direction of ceramic plates 41. In other words, the electric field that is generated between individual electrode 35 and common electrode 34 is parallel with the polar direction of ceramic plate 41. Thus, ceramic plate 41 is shortened in the horizontal direction by the electrostrictive effect caused by the electric field generated between individual electrode 35 and common electrode 34. In contrast, ceramic plates 42-44 are not shortened in the horizontal direction because they are not affected by the electric field. Thus, ceramic plates 41-44 will be deformed so as to form a convex shape projecting below in the range in which individual electrode 35 has applied a voltage (unimorph deformation). In other words, actuator 40 deforms so as to become a convex shape. Because actuator 40 deforms so as to become a convex shape projecting below, the volume of the pressure chamber 10 that corresponds thereto will become smaller than when actuator 40 is not deformed.

As shown in FIG. 7, electrical signal pattern 91 will transmit electrical signal Pa1 at the initiation of one dot printing period Pe, and after transmitting electric signal Pa1, will then transmit electrical signal Pb1 after AL has elapsed.

When driver IC 80 transmits electrical signal Pa1 to individual electrode 35, the potential of individual electrode 35*a* will change from $V_0$ to 0V. In contrast, because common electrode 34 is provided, the potential of individual electrode 35 and common electrode 34 is substantially the same. When this occurs, the electric field that was generated between individual electrode 35 and common electrode 34 will be eliminated. When the electric field between the individual electrode 35 and the common electrode 34 is eliminated, ceramic plate 41 that was shortened in the horizontal direction will return to its original state. When ceramic plate 41 returns to its original state, actuator 40 that was deformed so as to become convex projecting below will return to the flat state. When actuator 40 returns to the flat state, the volume of pressure chamber 10 will be increased. When the volume of pressure chamber 10 is increased, the pressure of the ink inside the pressure chamber 10 will be reduced. When this occurs, ink will be drawn from the branching passage 32 on the aperture 12 side corresponding to the pressure chamber 10 to the interior of the pressure chamber 10, and be replenished.

In addition, when the pressure inside the pressure chamber 10 is reduced, that pressure drop will become a pressure wave. The pressure wave is reflected by manifold 5*a* and nozzle 8. The pressure within the pressure chamber 10 changes cyclically due to reflected pressure wave. That cycle period is equivalent to a period for the pressure wave to reciprocate once in the passage that connects the manifold 5*a* and nozzle 8 via the pressure chamber. That period 2AL is referred to as the cycle time of the pressure wave as mentioned above. AL is referred to as the acoustic length. When AL has elapsed after the signal Pa1 was applied, the pressure within the pressure chamber is increased.

With electrical signal pattern 91, electrical signal Pb1 will be transmitted to individual electrode 35 at potential timing t1, at which electrical signal Pa1 has been transmitted and AL has elapsed. When electrical signal Pb1 is transmitted, the potential of individual electrode 35 will again be $V_0$. When this occurs, an electric field will be generated between individual electrode 35 and common electrode 34. When this occurs, actuator 40 will again deform so as to become convex from below, and the volume of pressure chamber 10 will be reduced. Because the ink inside pressure chamber 10 will be replenished when electrical signal Pa1 is transmitted to individual electrode 35, the ink inside pressure chamber 10 will be pressurized when the volume of pressure chamber 10 is reduced. In addition, as noted above, at the timing at which electrical signal Pa1 was transmitted and AL elapsed, the pressure of the liquid inside pressure chamber 10 will rise due to pressure wave. Thus, the ink inside pressure chamber 10 will be efficiently pressurized.

When ink inside pressure chamber 10 is pressurized, that pressure will become a pressure wave, and will propagate inside the branching passage 32. When positive pressure wave that propagated toward the downstream side arrives at nozzle 8, ink will be discharged from nozzle 8.

Pressure wave propagate inside branching passage 32 while repeatedly being reflected. Thus, the pressure of the ink inside pressure chamber 10 will change in a period 2AL (the time cycle of the pressure wave). As pressure wave will propagate inside branching passage 32 while they decrease, the pressure of the ink inside the pressure chamber 10 will eventually return to the original pressure.

FIG. 11 shows the simulated results of the changes in the pressure of ink inside pressure chamber 10 when an electrical signal was transmitted, and FIG. 11(*a*) is the simulation results when electrical signal pattern 91 was transmitted. In FIG. 11, the solid line indicates an electrical signal that driver IC 80 will transmit. The vertical axis represents electric potential, and the horizontal axis represents elapsed time. The dotted line represents the pressure of the liquid inside the pressure chamber. The vertical axis indicates that the pressure of ink inside pressure chamber 10. "0" indicates the pressure prior to an electrical signal being transmitted, and "+1" indicates the peak value of the pressure when electrical signal Pb1 was transmitted. The changes in the pressure of the ink inside the pressure chamber 10 have been normalized.

Simulation was performed by using an electric circuit that is equivalent to mechanical structure including the passage 32 connecting manifold 5*a* and nozzle 8 via pressure chamber 10 and actuator 40. The actuator 40 was replaced with condenser and coil, the passage connecting manifold 5*a* and pressure chamber 10 is replaced with coil and resistor, pressure chamber was replaced with condenser, and the passage connecting pressure chamber 10 and nozzle 8 was replaced with coil and resistor. In this equivalent electric circuit, the electric current flowing through the condenser replacing pressure chamber 10 becomes equal to the pressure variation within the pressure chamber 10.

As shown in FIG. 11(*a*), the pressure inside pressure chamber 10 will be reduced when electrical signal Pa1 is transmitted, and will increase when electrical signal Pb1 is transmitted. In addition, because electrical signal Pb1 is transmitted after electrical signal Pa1 was transmitted and AL elapsed, the pressure of the ink inside pressure chamber 10 is efficiently raised when electrical signal Pb1 was transmitted. Furthermore, after electrical signal Pb1 was transmitted, the pressure of the ink inside pressure chamber 10 will change at the cycle period of 2AL (12 μs in ink jet head 70) while returning to the original pressure gradually.

As described above, with electrical signal pattern 91, electrical signal Pb1 will be transmitted at potential timing t1, at which electrical signal Pa1 has been transmitted and AL has elapsed. Thus, the ink inside pressure chamber 10 will be efficiently pressurized when electrical signal Pb1 is transmitted from driver IC 80, one drop of ink will be discharged from nozzle 8, and a small dot will be printed on the paper.

Next, the operation when electrical signal pattern 92 is transmitted will be described. As shown in FIG. 7(*b*), electrical signal pattern 92 is formed from two drive pulses P. The timing at which electrical signal Pa1 and electrical signal Pb1 are transmitted will be the same as electrical signal pattern 91. Thus, actuator 40 and the passage will operate in the same way as when electrical signal pattern 91 is transmitted. In other words, one drop of ink will be discharged from nozzle 8 by electrical signal Pa1 and Pb1.

Electrical signal Pa2 will be transmitted when a predetermined time period of AL has elapsed after electrical signal Pb1 was transmitted. When this occurs, the ink inside pressure chamber 10 will be replenished.

Electrical signal Pb2 will be transmitted at potential timing t2 after electrical signal Pa2 was transmitted (after electrical signal Pb1 was transmitted and 2AL elapsed). When this occurs, actuator 40 will be driven, and the ink inside pressure chamber 10 will be pressurized. In addition, as noted above, the pressure of the ink inside pressure chamber 10 will rise due to pressure waves after electrical signal Pb1 is transmitted and 2AL elapsed. Thus, the pressure inside pressure chamber 10 will be efficiently increased by electrical signal Pb2.

When the ink inside pressure chamber 10 is pressurized, that pressure will become a pressure wave and will be propagated inside the branching passage 32. When the pressure wave that has propagated inside the branching passage 32 toward the downstream side reaches nozzle 8, an ink drop will be discharged from the nozzle 8. Thus, the second discharged ink drop will adhere to the target position as the first discharged ink drop. By adhering two ink drops to the target position, a medium dot that is one size larger than the small dot will be printed on the paper.

In addition, the pressure wave generated by the transmission of electrical signal Pb2 will be repeatedly reflected inside branching passage 32 while propagating inside the branching passage 32. Thus, the pressure of the ink inside pressure chamber 10 will change cyclically with the cycle period 2AL (the time cycle of the pressure wave).

FIG. 11(*b*) is a simulation result of the pressure changes inside pressure chamber 10 when electrical signal pattern 92 is transmitted. As shown in FIG. 11(*b*), the pressure when electrical signal Pb2 is transmitted will be 1.1 times the pressure when electrical signal Pb1 is transmitted. In other words, the ink inside pressure chamber 10 will be efficiently pressurized.

Note that with ink jet head 10 of the present embodiment, when the pressure inside pressure chamber 10 is 1.7 times or less than the pressure when electrical signal Pb1 was output, ink will be suitably discharged from the nozzle 8. In contrast, when the pressure inside pressure chamber 10 is greater than 1.7 times the pressure when electrical signal Pb1 was transmitted, ink leaked out from the nozzle 8. With electrical signal pattern 92, the largest value of the pressure inside pressure chamber 10 is 1.1 times, and thus ink will be suitably discharged from the nozzle 8.

As is clear from the description above, with electrical signal pattern 92, electrical signal Pb2 will be transmitted at potential timing t2, at which time electrical signal Pa1 has been transmitted and AL has elapsed. Thus, the pressure inside pressure chamber 10 will be efficiently increased. In addition, when electrical signal pattern 92 is transmitted to individual electrode 35, two drops of ink will be discharged from nozzle 8. The discharged ink will adhere to the target position on the paper, and a medium dot will be printed.

Next, the operation when electrical signal pattern 93 is transmitted will be described. As shown in FIG. 7(*c*), electrical signal 93 is formed from three drive pulses P. The timing at which electrical signals Pa1, Pb1, Pa2, and Pb2 are transmitted is the same as that of electrical signal pattern 92. Thus, actuator 40 and the passage will operate in the same way as when electrical signal pattern 92 is transmitted. In other words, two drops of ink will be discharged from nozzle 8 and adhered to the paper by electrical signals Pa1, Pb1, Pa2, and Pb2.

In electrical signal pattern 93, a null signal will be transmitted at potential timing t3 after electrical signal Pb2 was transmitted. Thus, actuator 40 will not drive at potential timing t3. In addition, the pressure of the ink inside pressure chamber 10 will rise due to a pressure wave after electrical signal Pb2 is transmitted and 2AL elapsed. This pressure is a comparatively large pressure wave that is generated when electrical signal Pb2 was transmitted. Thus, although the pressure inside pressure chamber 10 will rise, the pressure wave will pass through the pressure chamber 10 as is because the actuator 40 will not drive.

Electrical signal Pa3 will be transmitted when a predetermined period of time AL has elapsed after potential timing t3. When this occurs, the ink inside pressure chamber 10 will be replenished.

Electrical signal Pb3 will be transmitted at potential timing t4 after electrical signal Pa3 was transmitted (after electrical signal Pb2 was transmitted and 4AL elapsed). When this occurs, actuator 40 will be driven, and the ink inside pressure chamber 10 will be pressurized. In addition, the pressure of the ink inside pressure chamber 10 will rise due to the pressure wave after electrical signal Pb2 is transmitted and 4AL elapsed. At this point, the pressure wave has decreased to a certain extent, and thus the amount of increase in the pressure of the ink inside the pressure chamber 10 will be smaller than the amount of increase at the timing at which electrical signal Pb2 was transmitted and 2AL elapsed. The ink inside the pressure chamber 10 will be efficiently pressurized by the pressure wave and actuator 40 and achieve a suitable pressure.

When the ink inside pressure chamber 10 is pressurized, that pressure will become a pressure wave and will be propagated inside the branching passage 32. When the pressure wave that has propagated inside the branching passage 32 toward the downstream side reaches nozzle 8, an ink drop will be discharged from the nozzle 8. Thus, the third discharged ink drop will adhere to the target position as the two previously discharged ink drops. By adhering three ink drops to the target position, a large dot that is one size larger than the medium dot will be printed on the paper.

FIG. 11(*c*) is a simulation result of the pressure changes inside pressure chamber 10 when electrical signal pattern 93 is transmitted. As shown in FIG. 11(*c*), the pressure of the ink inside pressure chamber 10 when electrical signal Pb3 is transmitted will be 1.3 times the pressure when electrical signal Pb1 is transmitted. In other words, because the pressure of the ink inside pressure chamber 10 is 1.7 times or less than the pressure when electrical signal Pb1 was output, ink will be suitably discharged from the nozzle 8.

Figure 13:
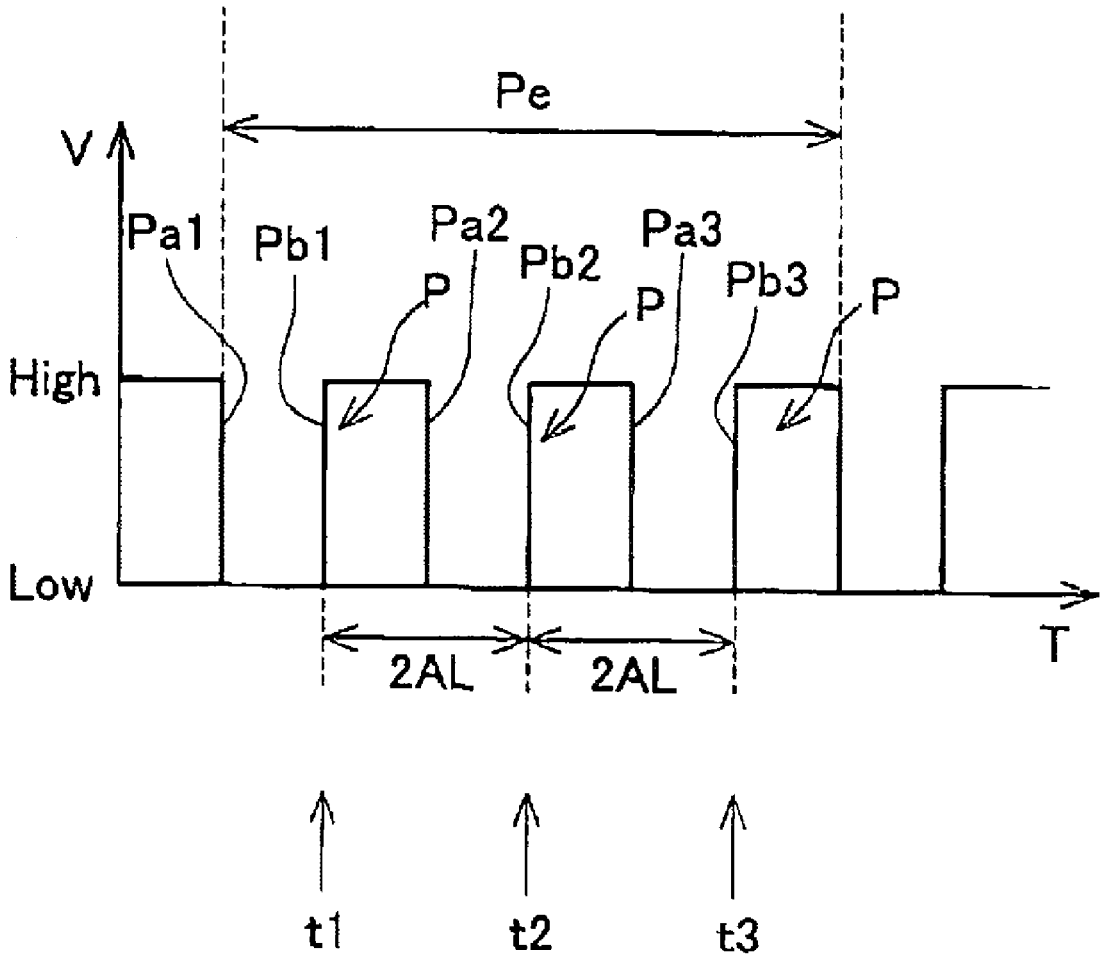
FIG. 13 is a waveform of a conventionally used drive signal.
Figure 14:
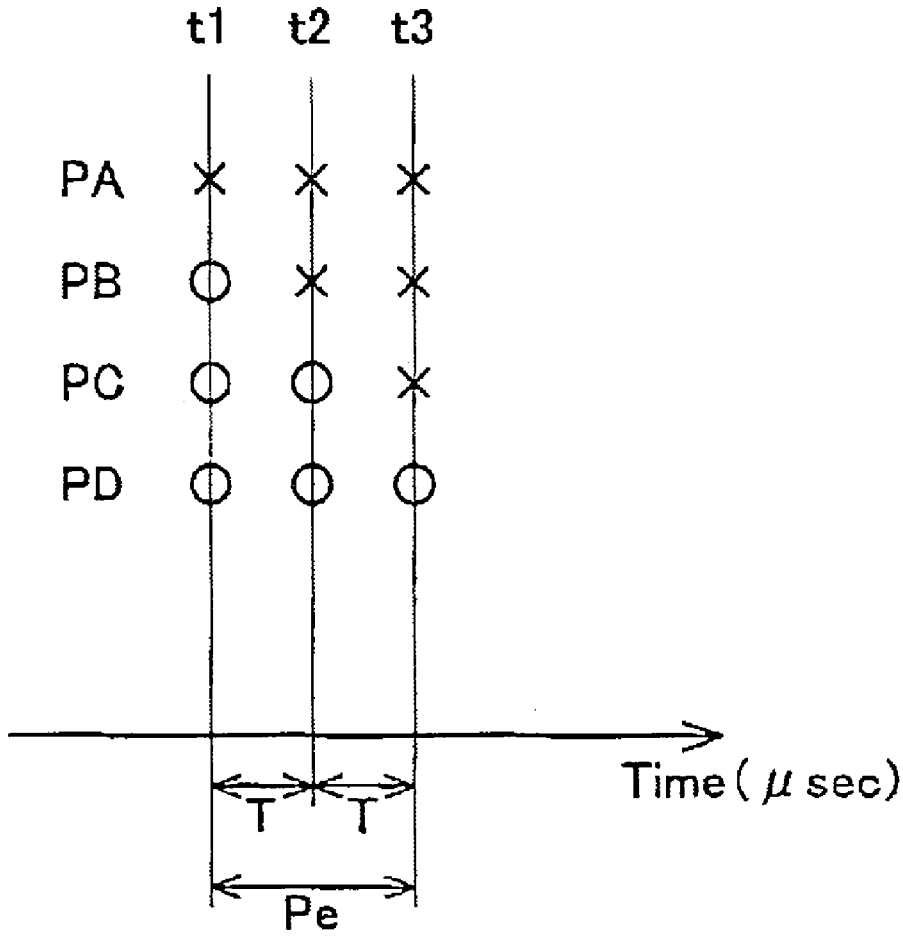
FIG. 14 shows a conventionally used drive signal in frame format.

Here, electrical signal pattern 94 will be described. Electrical signal pattern 94 is an electrical signal which is not transmitted from driver IC 80, but will be described as a comparison to electrical signal 93. FIG. 13 is an output pattern of electrical signal 94. As shown in FIG. 13, electrical signal 94 is also formed from three drive pulses P. The timing at which electrical signals Pa1, Pb1, Pa2, and Pb2 are transmitted is the same as that of electrical signal pattern 92. Thus, actuator 40 and the passage will operate in the same way as when electrical signal 92 is transmitted.

Electrical signal Pa3 will be transmitted when predetermined period of AL has elapsed after electrical signal Pb2 was transmitted. When this occurs, the ink inside pressure chamber 10 will be replenished.

Electrical signal Pb3 will be transmitted at potential timing t3 after electrical signal Pa3 was transmitted (after electrical signal Pb2 was transmitted and 2AL elapsed). When this occurs, actuator 40 will be driven, and the ink inside pressure chamber 10 will be pressurized. In addition, the pressure of the ink inside pressure chamber 10 will rise due to a pressure wave after electrical signal Pb2 is transmitted and 2AL elapsed. At this point, the pressure of the ink inside pressure chamber 10 will rise due to a comparatively large pressure wave that was generated when electrical signal Pb2 was output. Thus, the ink inside pressure chamber 10 will be efficiently pressurized, and will reach an extremely high pressure.

When the ink inside the pressure chamber 10 reaches an extremely high pressure, that pressure will become an extremely large pressure wave and will propagate inside the branching passage 32. When the pressure wave that has propagated inside the branching passage 32 toward the downstream side reaches nozzle 8, ink will leak out from nozzle 8.

FIG. 11(*f*) is a simulation result of the pressure changes inside pressure chamber 10 when electrical signal pattern 94 is transmitted. As shown in FIG. 11(*f*), the pressure inside pressure chamber 10 when electrical signal pattern Pb3 is transmitted will be about 1.9 times the pressure when electrical signal Pb1 is transmitted, and will be 1.7 times as large. Thus, when electrical signal pattern 94 is transmitted from driver IC 80, ink will leak out from nozzle 8. When ink leaks out from nozzle 8, the leaked ink will adhere to the area around nozzle 8. When this occurs, the discharge quantity, discharge direction, and discharge speed of the ink to be discharged from the nozzle 8 next will change due to the adhered liquid. In addition, the pressure of the ink inside pressure chamber 10 will rise due to the remaining pressure wave, after electrical signal Pb3 is transmitted and 2AL elapsed. The pressure of the ink inside pressure chamber 10 at this point will rise to approximately the same level as when electrical signal Pb1 was transmitted. Thus, a problem will occur in which ink will discharge from nozzle 8 by itself.

As is clear from the description of electrical signal patterns 93 and 94 above, with electrical signal pattern 93, a null signal will be transmitted at potential timing t3 after electrical signal Pb2 was transmitted and 2AL elapsed. Thus, the pressure inside pressure chamber 10 will be prevented from becoming too high. Then, electrical signal Pb3 will be transmitted at potential timing t4 (i.e., after the second electrical signal Pb was transmitted and 4AL elapsed). In this way, the ink inside pressure chamber 10 will be efficiently pressurized, and will achieve a suitable high pressure. Thus, when electrical signal pattern 93 is to be transmitted, three drops of ink will be discharged from nozzle 8. The discharged irk will adhere to the target position on the paper, and a large dot will be printed.

Note that with electrical signal pattern 93, a time interval Ts is set in which an electrical signal will not be transmitted. There is provided a time interval Ts between a last signal Pb3 within a preceding period Pe of one dot printing and a first signal Pa1 within a following period of one dot printing. An electrical signal will not be transmitted to individual electrodes 35 during time interval Ts. Thus, any pressure waves remaining inside branching passage 32 will decrease. In this way, the remaining pressure waves will be prevented from affecting the next period of one dot printing.

As described above, with ink jet head module 1 of the present embodiment, electrical signal Pb will be transmitted at one potential timing of t1-t4 that is set to match the cycle time 2AL of the pressure wave, and electrical signal Pb will not be transmitted at any other timing. When a plurality of electrical signal Pb are consecutively output, electrical signal Pb will be transmitted in association with the cycle time of the pressure wave, and thus the ink inside pressure chamber 10 will be efficiently pressurized. As shown in FIG. 7 (*b*), when two drive signals P are transmitted within the period of one dot printing, the two consecutive signals Pb1, Pb2 are transmitted sequentially at an interval that is equal to the cycle time of the pressure wave generated within the pressure chamber.

In addition, driver IC 80 will not transmit three or more pulse signals P consecutively. As shown in FIG. 7 (*c*), when three drive signals P are transmitted within the period of one dot printing, one null signal is adopted at intermediate potential timing t3. Therefore, the second signal Pb2 and third signal Pb3 are transmitted at an interval that is equal to the two times of the cycle time of the pressure wave generated within the pressure chamber. Thus, the pressure of the ink inside pressure chamber 10 will be prevented from becoming too high. Due to this, the occurrence of problems such as the leakage of ink from the nozzle can be avoided.

In addition, driver IC 80 will determine the number of pulse signals P to be transmitted to the actuator during period Pe of one dot printing, based upon the size of the dot to be printed at the target position. In this way, dots of different size will be printed, and designs can be printed in gray-scale based upon design data.

In addition, with electrical signal pattern 93 that is transmitted by a driver IC, the time interval Ts in which an electrical signal will not be transmitted is set to be the interval from when electrical signal Pb3 is transmitted within period Pe of one dot printing at a first target position, until electrical signal Pa1 is transmitted within period Pe of one dot printing at a second target position. In this way, the impact of the pressure wave generated by means of the discharge to the first target position on the discharge to the second target position can be inhibited.

Note that the aforementioned electrical signal pattern 93 is set such that electrical signal Pb1 will be transmitted at potential timing t1, electrical signal Pb2 will be transmitted at potential timing t2, a null signal will be transmitted at potential timing t3, and electrical signal Pb3 will be transmitted at potential timing t4. However, the present invention is not limited to this type of embodiment.

Figure 8:
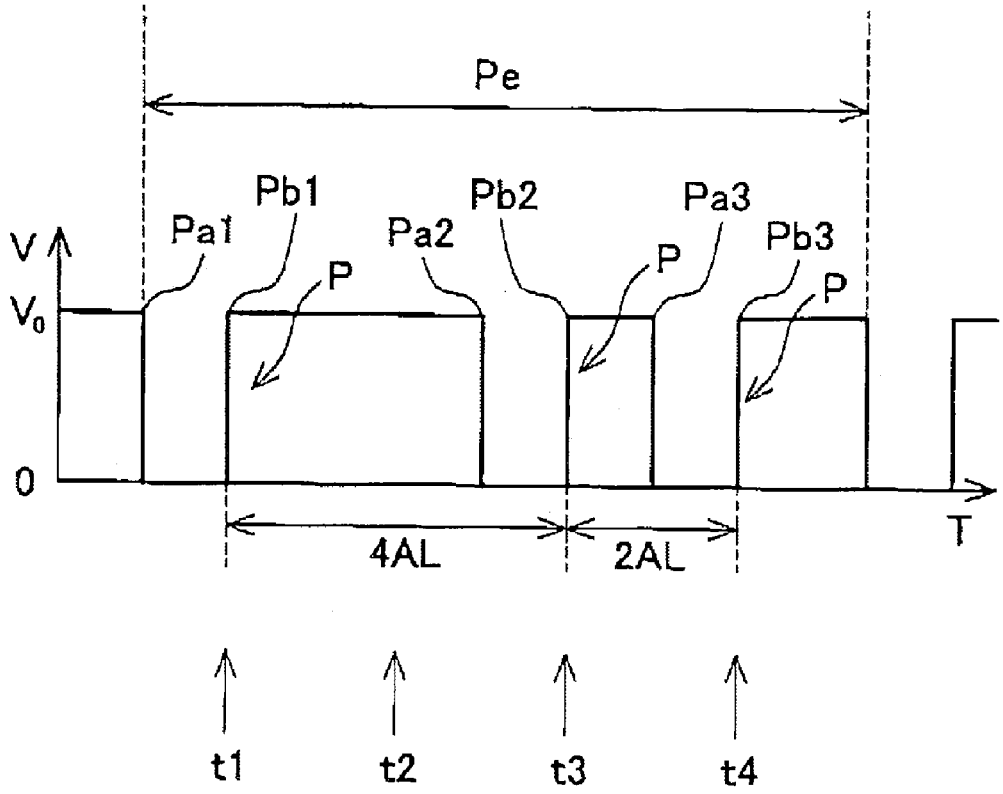
FIG. 8 is a waveform of a drive signal in a changed state.

For example, as shown in FIG. 8, it is also possible for a null signal to be transmitted at potential timing t2, and electrical signal Pb2 to be transmitted at potential timing t3. When an electrical signal with this type of configuration is transmitted, as shown in FIG. 11(*d*), the maximum value of the pressure inside pressure chamber 10 will be 1.7 times the pressure when the first electrical signal Pb1 was transmitted. Thus, ink can be suitably discharged even by transmitting this electrical signal.

Figure 9:
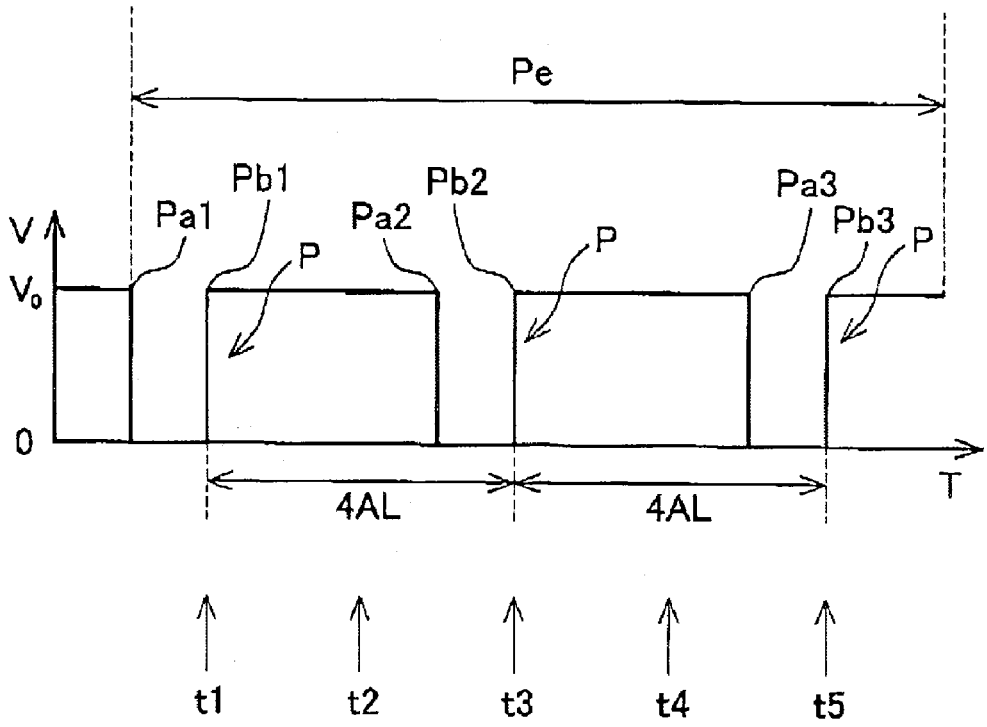
FIG. 9 is a waveform of a drive signal in another changed state.

In addition, even if a null signal is transmitted, an additional null signal may also be transmitted in a situation in which the pressure of the ink inside pressure chamber 10 is too high. For example, as shown in FIG. 9, potential timings t1-t5 are set during period Pe of one dot printing. Then, electrical signal Pb1 may be transmitted at potential timing t1, a null signal may be transmitted at potential timing t2, electrical signal Pb2 may be transmitted at potential timing t3, a null signal may be transmitted at potential timing t4, and an electrical signal Pb3 may be transmitted at potential timing t5. When an electrical signal with this type of configuration is transmitted, as shown in FIG. 11(*e*), the maximum value of the pressure inside pressure chamber 10 will be 1.2 times the pressure when electrical signal Pb1 was transmitted. Thus, ink can be suitably discharged even by transmitting this electrical signal.

In the alternative, null signals may be consecutively transmitted at a potential timing. For example, electrical signal Pb2 will be transmitted at potential timing t2, a null signal will be transmitted at potential timings t3 and t4, and electrical signal Pb3 will be transmitted at potential timing t5 (i.e., electrical signal Pb3, will be transmitted at a timing at which electrical signal Pb2 was transmitted and period 6AL has elapsed. Even with electrical signals having this type of configuration, the pressure inside pressure chamber 10 can be prevented from becoming too large, and the pressure inside pressure chamber 10 can be efficiently raised.

In general, when a number of the signals transmitted to the actuator within the period of one dot printing is equal to or more than a predetermined number (3 in this embodiment), at least one interval is a product of an integer and the cycle time, wherein the integer is more than two. In FIGS. 8 and 9, the integer is 2 for 4AL and 3 for 6AL. By adjusting at least one interval to be equal to the product of the integer and the cycle time, wherein the integer is two or more, the pressure inside pressure chamber 10 can be prevented from becoming too large.

In addition, even in a situation in which four or more electrical signals Pb are to be transmitted during period Pe of one dot printing, by applying a null signal, the pressure inside pressure chamber 10 can be prevented from becoming too high, and the pressure inside pressure chamber 10 can be efficiently raised.

Furthermore, when only two electrical signals Pb1, Pb2 are to be transmitted during period Pe for one dot printing, a null signal may be transmitted at an intermediate potential timing between two electric signals Pb1 and Pb2. Even with electrical signals having this type of configuration, the pressure inside pressure chamber 10 can be prevented from becoming too large, and the pressure inside pressure chamber 10 can be efficiently raised.

Figure 10:
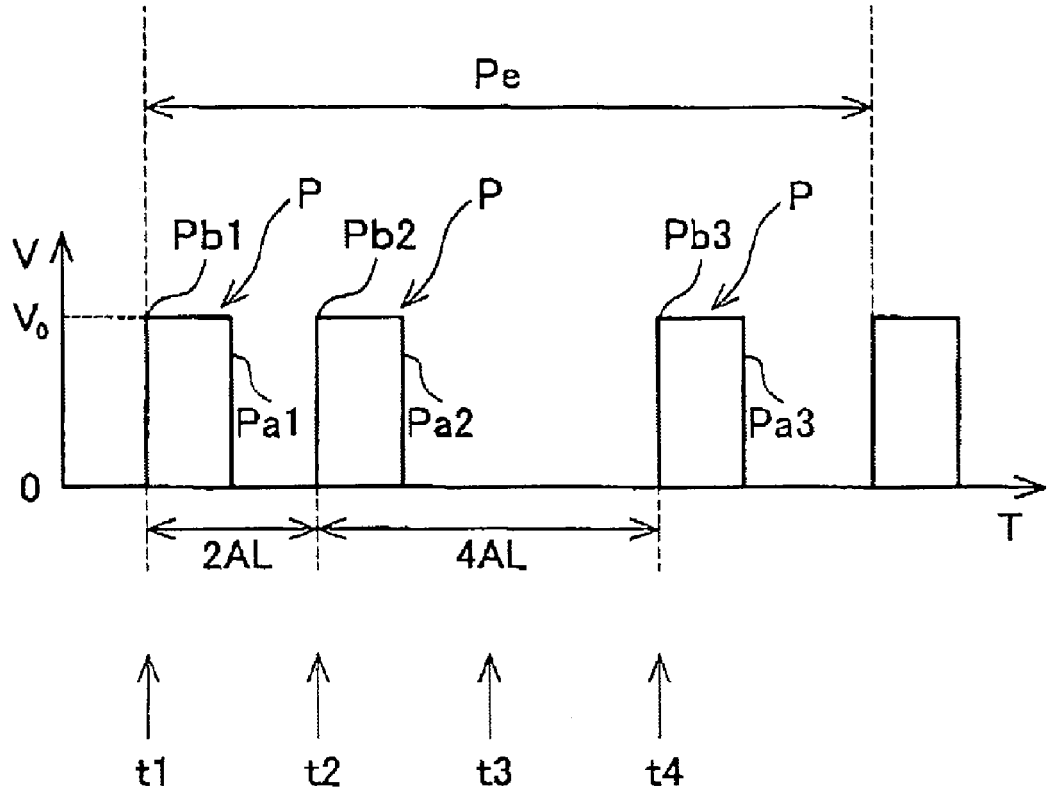
FIG. 10 is a waveform of a drive signal in yet another changed state, transmitted when ink is to be discharged in a drive method.
Figure 11A:
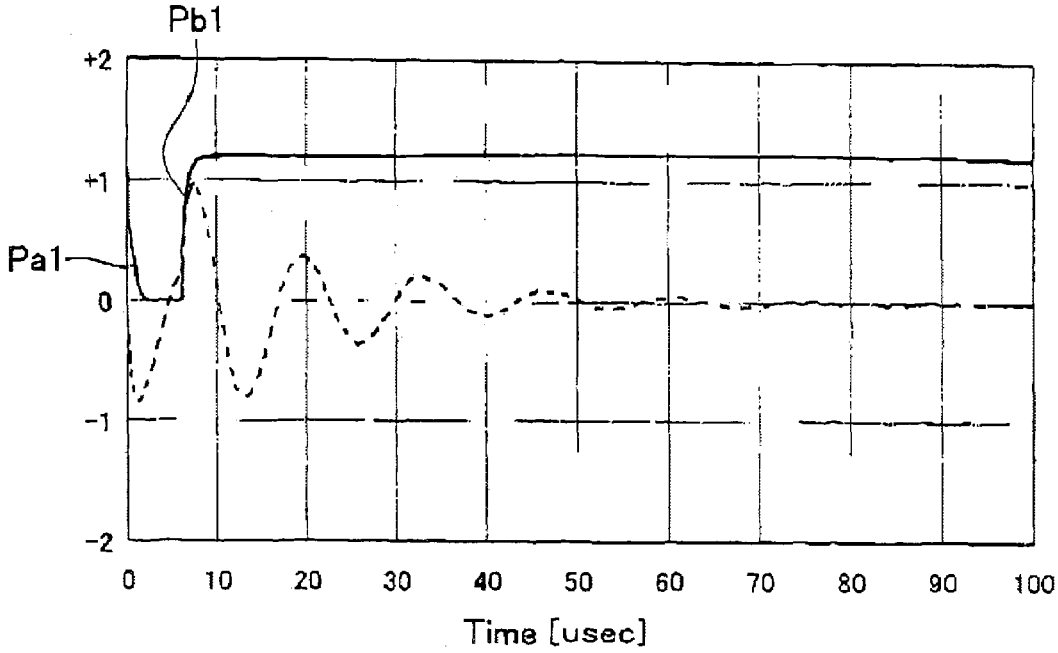
FIG. 11(*a*) shows the pressure variation in a pressure chamber when the drive signal of FIG. 7(*a*) was applied.
Figure 11B:
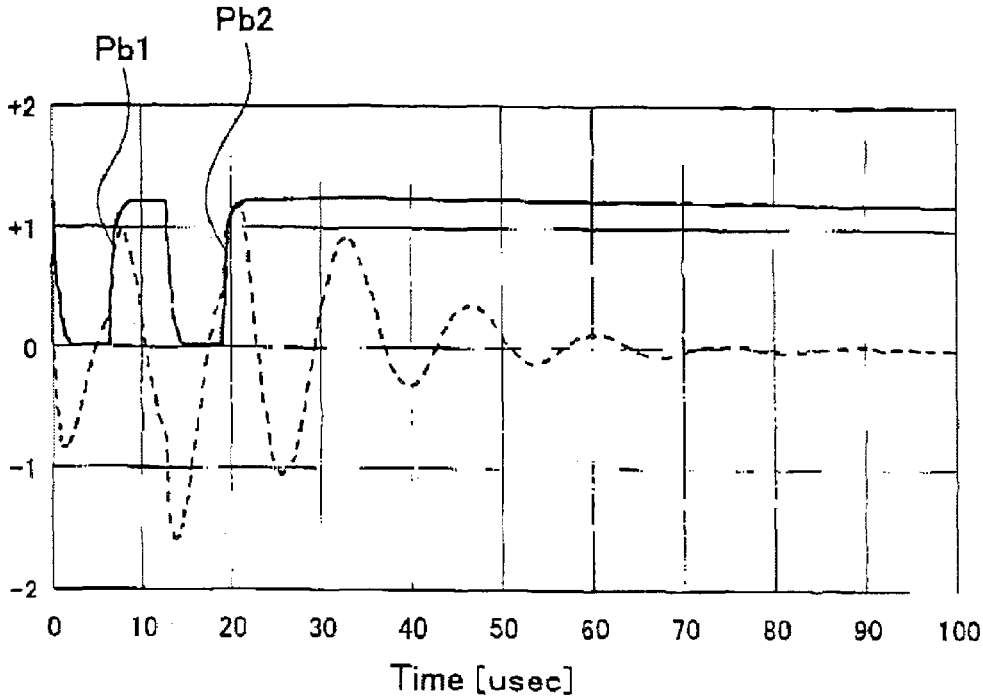
Figure 11C:
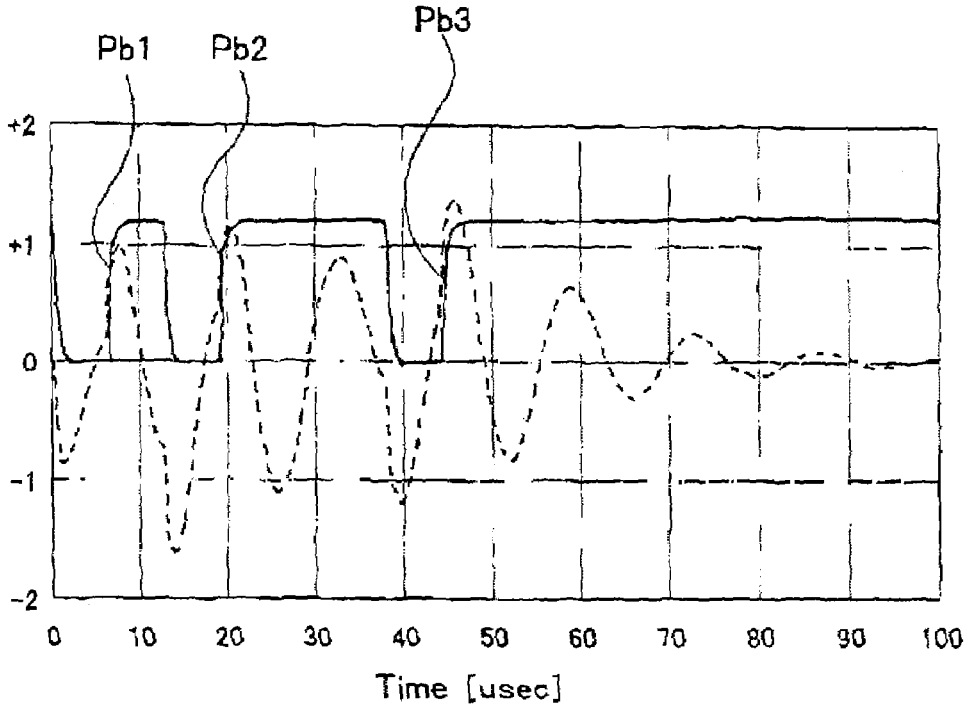
Figure 11D:
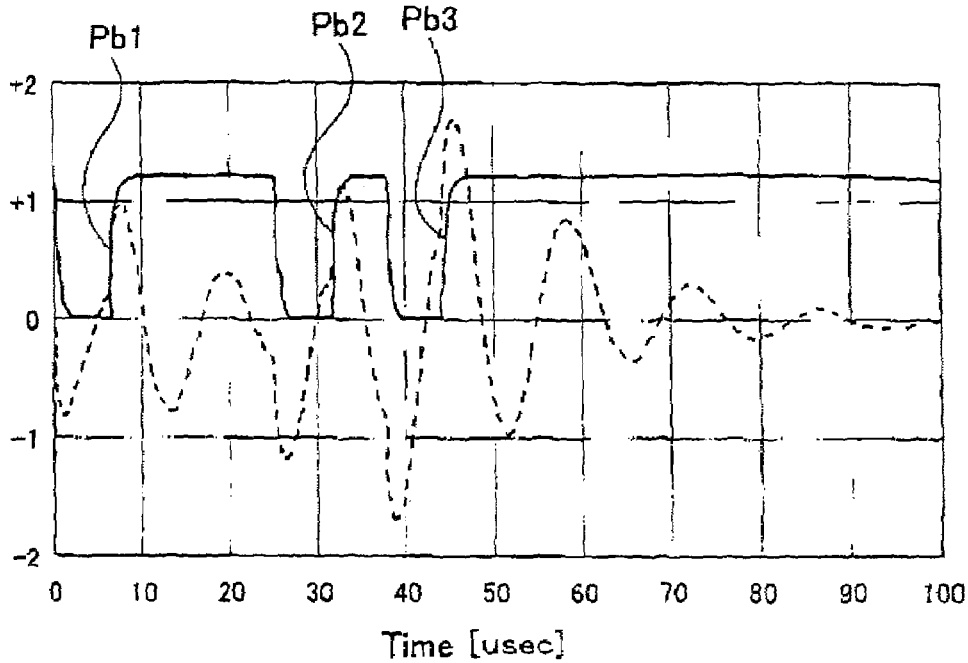
Figure 11E:
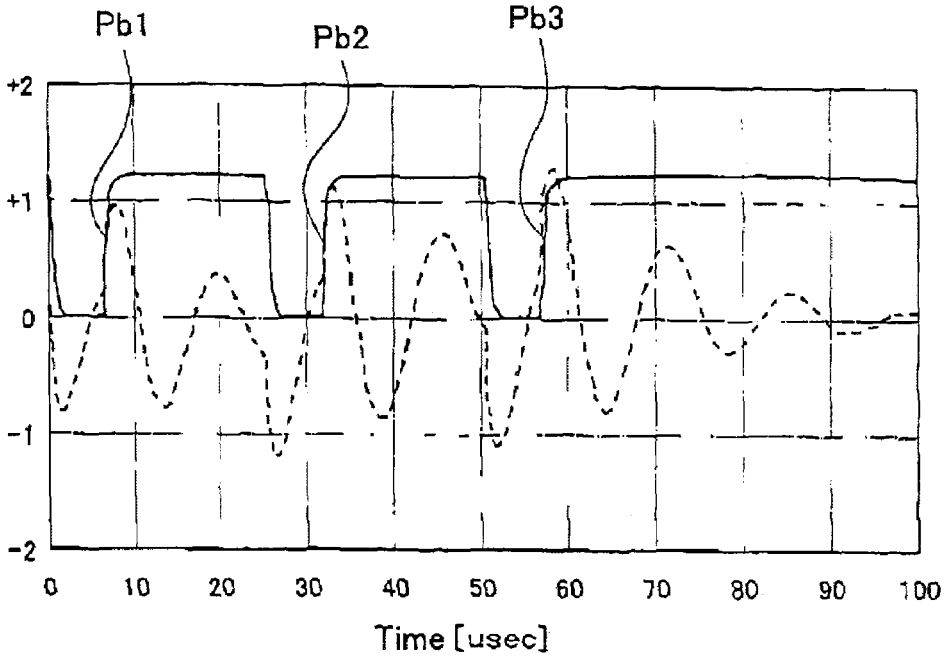
Figure 11F:
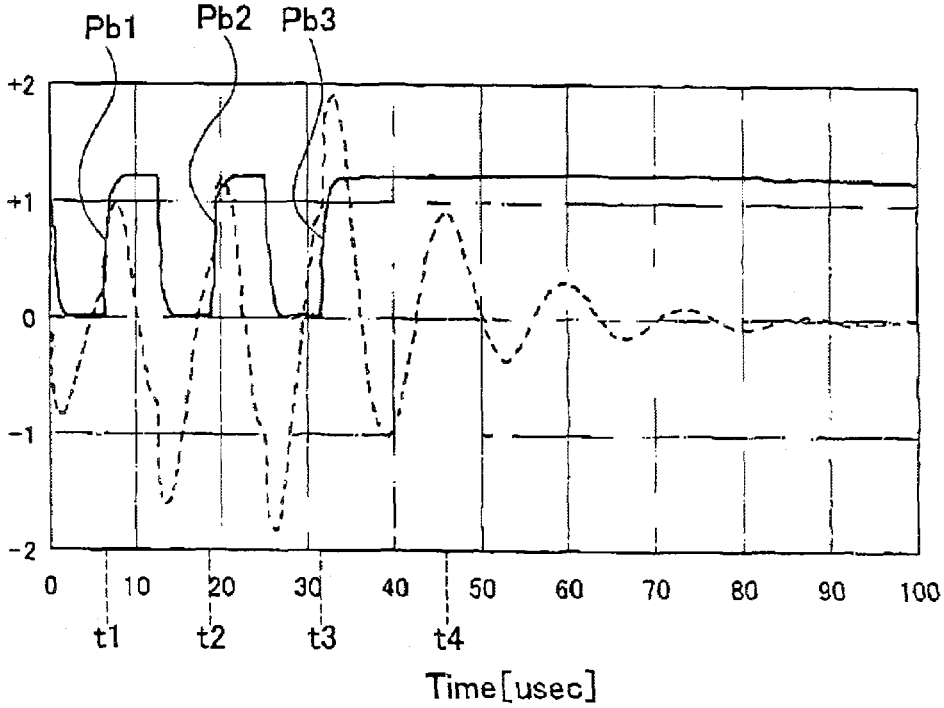

In addition, the aforementioned embodiment will temporarily reduce the pressure of the ink inside pressure chamber 10 and then increase the pressure, or in other words, the ink was discharged by forcibly drawing the ink. However, the present invention can also increase the pressure of ink inside pressure chamber 10 and then reduce the pressure, or in other words, the present invention can also be applied to forcibly pushing the ink. The waveform of an electrical signal when ink is discharged by forcibly pushing it is shown in FIG. 10. The electrical signal of FIG. 10 is formed by three drive pulses P. With the electrical signal pattern of FIG. 10, the potential of individual electrode 35 is normally maintained at 0V by driver IC 80 (prior to initiating print period Pe). Then, after electrical signal Pb was transmitted, electrical signal Pa will be transmitted. Thus, the ink inside pressure chamber 10 will be efficiently pressurized, and then reduced. With this electrical signal, electrical signal Pb1 will be transmitted at potential timing t1, electrical signal Pb2 will be transmitted at potential timing t2, a null signal will be transmitted at potential timing t3, and electrical signal Pb3 will be transmitted at potential timing t4. Thus, even with this electrical signal, the pressure of the ink inside pressure chamber 10 can be prevented from becoming too high, the ink inside the pressure chamber will be efficiently pressurized, and a suitably high pressure can be achieved.

In addition, in the aforementioned embodiment, an actuator that increases the pressure of a pressure chamber by deformation was described, but an actuator that heats the ink inside the pressure chamber to increase the pressure is also possible.

It may be preferred that the driver selects a number of pulse signals transmitted to the actuator within the period depending on an amount of the liquid to be discharged to the target position.

Due to this, the intended quantity of liquid can be adhered to the target position.

When the droplet discharge device is an inkjet printer, it may be preferred that the driver selects a number of pulse signals transmitted to the actuator within the period depending on a size of a dot to be printed on the target position.

When the size of the dot is classified into four levels, the driver preferably transmits no signals within the period when the dot is not to be printed on the target position, preferably transmits one signal within the period when the given size is small, preferably transmits two signals within the period when the given size is intermediate, and preferably transmits three signals within the period when the given size is large.

When the driver transmits "3 signals" within the period, a first interval between first and second signals may be substantially equal to the cycle time and a second interval between second and third signals may be substantially equal to two times of the cycle time. This sequential pattern corresponds to a combination of signal at first potential timing, signal at second potential timing, null signal at third potential timing and signal at fourth potential timing. Instead, the first interval may be equal to two times of the cycle time and the second interval may be equal to the cycle time. This sequential pattern corresponds to a combination of signal at first potential timing, null signal at second potential timing, signal at third potential timing and signal at fourth potential timing.

It may also be preferred that there is provided a time interval between a last signal within a preceding period for printing one dot and a first signal within a following period for printing another dot. In this case, the magnitude of the pressure wave decreases during the time interval.

In this situation, the influence of the pressure wave generated by means of the discharge to the first target position does not affect on the discharge to the second target position.

When the actuator comprises a piezo-electric element and changes the volume of the pressure chamber when the pulse signal is applied to the piezo-electric element, the pulse signal for applying pressure to the liquid within the pressure chamber may be a pulse signal changing from high voltage to low voltage or a pulse signal changing from low voltage to high voltage.

In a case that the actuator comprises the piezo-electric element, a pair of first signal for increasing the volume of the pressure chamber and second signal for reducing the volume of the pressure chamber may be used. When the first signal is applied, negative pressure is generated within the pressure chamber, and this negative pressure causes pressure wave within the passage connecting the liquid storage chamber and the nozzle via the pressure chamber. Therefore, the pressure within the pressure chamber becomes a peak when a half cycle time of the pressure wave has elapsed after the first signal. If the first signal precedes the second signal by the half cycle time of the pressure wave, the second signal is applied at timing when the pressure within the pressure chamber becomes the peak.

The first signal for increasing the volume of the pressure chamber may be the pulse signal changing from high voltage to low voltage. In this case, the second signal for decreasing the volume of the pressure chamber may be the pulse signal changing from low voltage to high voltage. Alternatively, first signal for increasing the volume of the pressure chamber may be the pulse signal changing from low voltage to high voltage. In this case, the second signal for decreasing the volume of the pressure chamber may be the pulse signal changing from high voltage to low voltage.

What is claimed is:

1. A droplet discharge device comprising:

a pressure chamber storing liquid to be discharged;

an actuator applying pressure to the liquid within the pressure chamber when the actuator receives a signal;

a nozzle connected to the pressure chamber and discharging a droplet when the actuator receives the signal; and a driver that transmits the signals sequentially to the actuator within a period of discharging droplets toward a target position, wherein when a number of the signals transmitted by the driver to the actuator within the period is greater than or equal to three signals, consecutive three signals transmitted by the driver satisfy the following condition:

a first interval between a first signal and a second signal of the consecutive three signals is substantially equal to a product of an integer and a cycle time of a pressure wave generated within the pressure chamber, wherein the integer is two or more, and a second interval between the second signal and a third signal of the consecutive three signals is substantially equal to the cycle time, wherein each of the consecutive three signals corresponds to a transition from a lower voltage to a higher voltage.

2. A droplet discharge device as in claim 1, wherein the driver selects the number of the signals transmitted to the actuator within the period depending on an amount of the liquid to be discharged to the target position.

3. A droplet discharge device as in claim 1, wherein the liquid is ink, and the nozzle discharges ink droplets within the period toward a printing medium to print a dot.

4. A droplet discharge device as in claim 1, wherein the integer is two.

5. A droplet discharge device as in claim 1, wherein there is provided a time interval between a last signal within a preceding period of discharging droplets toward a target position and the first signal within a following period of discharging droplets toward a target position, and wherein a magnitude of the pressure wave decreases during the time interval.

6. A droplet discharge device as in claim 1, wherein the driver transmits no more than three signals within the period.

7. A droplet discharge device as in claim 1, wherein the actuator comprises a piezo-electric element and changes volume of the pressure chamber when the signal is applied to the piezo-electric element.

8. A droplet discharge device as in claim 1, wherein the liquid within the pressure chamber receives pressure when a pulse signal changing from high voltage to low voltage or a pulse signal changing from low voltage to high voltage is applied to the actuator.

9. A droplet discharge device as in claim 3, wherein the driver selects the number of signals transmitted to the actuator within the period based on a size of the dot to be printed on the target position.

10. A droplet discharge device as in claim 8, wherein the driver transmits a first predetermined signal for increasing the volume of the pressure chamber and a second predetermined signal for reducing the volume of the pressure chamber, the first predetermined signal precedes the second predetermined signal by about one half of the cycle time, one of the first predetermined signal and the second predetermined signal is a pulse signal changing from high voltage to low voltage, and the other of the first predetermined signal and the second predetermined signal is a pulse signal changing from low voltage to high voltage.

11. A droplet discharge device as in claim 4, wherein the size of the dot is classified into four levels, and wherein the driver transmits none of the signals within the period when the dot is not to be printed on the target position, transmits one of the signals within the period when the size is small, transmits two of the signals within the period when the size is intermediate, and transmits three of the signals within the period when the size is large.

12. A driver for transmitting signals sequentially to an actuator of a droplet discharge device, the droplet discharge device comprising a pressure chamber storing liquid to be discharged, the driver comprising a signal transmitter wherein the signal transmitter transmits signals sequentially within a period of discharging droplets toward a target position, wherein when a number of the signals transmitted by the driver to the actuator within the period is greater than or equal to three signals, consecutive three signals transmitted within the period satisfy the following condition:

a first interval between a first signal and a second signal of the consecutive three signals is substantially equal to a product of an integer and a cycle time of a pressure wave generated within the pressure chamber, wherein the integer is two or more, and a second interval between the second signal and a third signal of the consecutive three signals is substantially equal to the cycle time, wherein each of the consecutive three signals corresponds to a transition from a lower voltage to a higher voltage.

13. A method of driving a droplet discharge device the droplet discharge device comprising a pressure chamber storing liquid to be discharged, the method comprising:

inputting an amount of liquid to be discharged to a target position;

storing a plurality of sequential patterns of signals;

selecting one of the sequential patterns depending on the inputted amount; and transmitting signals according to the selected sequential pattern to an actuator for discharging droplets sequentially from the droplet discharge device toward the target position, wherein the sequential patterns of the signals are prepared, such that when a number of the signals transmitted to the actuator within a period of discharging droplets toward the target position is greater than or equal to three signals, consecutive three signals transmitted within the period satisfy the following condition:

a first interval between a first signal and a second signal of the consecutive three signals is substantially equal to a product of an integer and a cycle time of a pressure wave generated within the pressure chamber, wherein the integer is two or more, and a second interval between the second signal and a third signal of the consecutive three signals is substantially equal to the cycle time, wherein each of the consecutive three signals corresponds to a transition from a lower voltage to a higher voltage.

* * * * *